US011501677B2

(12) United States Patent
Jin et al.

(10) Patent No.: US 11,501,677 B2
(45) Date of Patent: Nov. 15, 2022

(54) DISPLAY MODULE, DRIVING METHOD THEREOF AND DISPLAY DEVICE

(71) Applicant: WUHAN CHINA STAR OPTOELECTRONICS SEMICONDUCTOR DISPLAY TECHNOLOGY CO., LTD., Wuhan (CN)

(72) Inventors: Zengjian Jin, Wuhan (CN); Fuchih Chang, Wuhan (CN); Qibing Dai, Wuhan (CN)

( * ) Notice: Subject to any disclaimer, the term of this patent is extended or adjusted under 35 U.S.C. 154(b) by 109 days.

(21) Appl. No.: 17/053,781

(22) PCT Filed: Jun. 22, 2020

(86) PCT No.: PCT/CN2020/097408
§ 371 (c)(1),
(2) Date: Nov. 8, 2020

(87) PCT Pub. No.: WO2021/223295
PCT Pub. Date: Nov. 11, 2021

(65) Prior Publication Data

US 2022/0189361 A1 Jun. 16, 2022

(30) Foreign Application Priority Data

May 8, 2020 (CN) ..... 202010382062.9

(51) Int. Cl.
*G09G 3/20* (2006.01)

(52) U.S. Cl.
CPC ..... *G09G 3/20* (2013.01); *G09G 2300/0408* (2013.01); *G09G 2310/0267* (2013.01); *G09G 2330/021* (2013.01)

(58) Field of Classification Search
CPC ..... G09G 3/20; G09G 2300/0408; G09G 2310/0267; G09G 2330/021
See application file for complete search history.

(56) References Cited

U.S. PATENT DOCUMENTS

| | | | | |
|---|---|---|---|---|
| 2008/0024480 | A1 | 1/2008 | Jee et al. | |
| 2017/0004766 | A1* | 1/2017 | Cho | G06F 1/1652 |
| 2017/0004798 | A1* | 1/2017 | Park | G09G 3/3677 |
| 2018/0357952 | A1* | 12/2018 | Yang | G09G 3/3208 |
| 2018/0358340 | A1* | 12/2018 | Wong | H01L 33/504 |
| 2019/0355299 | A1 | 11/2019 | Tan | |

(Continued)

FOREIGN PATENT DOCUMENTS

| | | |
|---|---|---|
| CN | 102143275 A | 8/2011 |
| CN | 105913808 A | 8/2016 |

(Continued)

*Primary Examiner* — Sejoon Ahn

(57) ABSTRACT

The present application provides a display module, a driving method thereof, and a display device. The display module comprises: a display panel comprising at least two display areas; a detection module configured to detect a fold state of the display panel; and a driving chip module comprising one-to-one correspondence with the display area and drive its display drive chip; a gating module configured to control connection or disconnection of a line where the gating module is located; a control platform configured to output control instructions. Alleviate the problem of excessive power consumption in existing folding display devices.

20 Claims, 16 Drawing Sheets

(56) References Cited

U.S. PATENT DOCUMENTS

| | | | |
|---|---|---|---|
| 2020/0117050 | A1 | 4/2020 | Shao et al. |
| 2020/0152725 | A1 | 5/2020 | Chen et al. |

FOREIGN PATENT DOCUMENTS

| | | | |
|---|---|---|---|
| CN | 108666355 | A | 10/2018 |
| CN | 109192146 | A | 1/2019 |
| CN | 109243309 | A | 1/2019 |
| CN | 109473043 | A | 3/2019 |
| CN | 109584806 | A | 4/2019 |
| CN | 109859674 | A | 6/2019 |
| CN | 110266843 | A | 9/2019 |
| CN | 110320690 | A | 10/2019 |
| CN | 110491331 | A | 11/2019 |
| CN | 110827759 | A | 2/2020 |
| CN | 111028762 | A | 4/2020 |
| CN | 210443248 | U | 5/2020 |
| KR | 20080022311 | A | 3/2008 |

* cited by examiner

DISPLAY MODULE, DRIVING METHOD THEREOF AND DISPLAY DEVICE

BACKGROUND OF INVENTION

Field of Invention

The present application relates to the field of display, specifically, to a display module, a driving method thereof, and a display device.

Description of Prior Art

With development of a flexible display substrate technology, a foldable display panel is gradually moving towards applications. The foldable display panel generally uses two or more driving chips (driver integrated circuit, DIC for short) for cascaded driving due to a larger screen display area. As shown in FIG. 1, the folding display panel 100 comprises a first display area (1) and a second display area (2). The first display area (1) is driven by DIC 1, and the second display area (2) is driven by DIC 2 to drive.

When the folding display panel is in use, when in a non-folded state, the first display area (1) and the second display area (2) are both light-emitting display areas. When in a folded state, only part of the display areas is displayed, such as the second display area (2) is folded, only the first display area (1) is displayed, and the second display area (2) is not displayed. However, although the second display area (2) is not displayed, its corresponding DIC 2 is still in a working state, which increases the power consumption of the entire display panel and the control platform 200.

Therefore, existing folding display devices have the problem of excessive power consumption.

SUMMARY OF INVENTION

The present application provides a display module, a driving method thereof, and a display device to improve the problem of excessive power consumption in an existing folding display device.

The present application provides a display module, comprising:

a display panel comprising at least two display areas and at least one folding area located between the display areas;

a driving chip module comprising at least two driving chips corresponding to the display areas in a one-to-one correspondence and configured to drive a corresponding one of the display areas to display;

a gating module connecting to the driving chips and configured to control connection or disconnection of a line where the gating module is located;

a detection module configured to detect a fold state of the display panel; and a control platform comprising a microcontroller, wherein the microcontroller is configured to output a driving instruction to the driving chips and to output a gating instruction to the gating module;

wherein the microcontroller outputs the driving instruction to all of the driving chips, all of the driving chips work, and all of the display areas are driven to display when the display panel is in an unfolded state, and the microcontroller outputs the driving instruction to one of the driving chips corresponding to an unfolded one of the display areas, the driving chip corresponding to the unfolded display area works, another one of the driving chips corresponding to a folded one of the display areas does not work, the unfolded display area displays, and the folded display area does not display when the display panel is in a folded state.

In the display module provided by the present application, the gating module connects to two adjacent one of the driving chips.

In the display module provided by the present application, the gating module comprises a plurality of gating units, and each of the gating units corresponds one-to-one to a connection signal disposed between the two adjacent driving chips.

In the display module provided by the present application, each of the gating units comprises a gating member, one end of the gating member is connected to one of the two adjacent driving chips, another end of the gating member is connected to another one of the two adjacent driving chips, and the gating member is configured to control connection and disconnection of a line disposed between the two adjacent driving chips.

In the display module provided by the present application, the gating module is connected to the driving chips and a gate driving circuit of the display panel.

In the display module provided by the present application, the gating module comprises a plurality of gating units, and each of the gating units corresponds one-to-one to an input signal of the gate driving circuit.

In the display module provided by the present application, each of the gating units comprises two gating members, and the two gating members respectively correspond to two of the driving chips.

In the display module provided by the present application, one end of the gating member is connected to an output end of the corresponding driving chip, the output end is corresponding to the input signal, another end of the gating member is connected to an input end of the gate driving circuit, the input end is corresponding to the input signal, and the gating member is configured to control connection and disconnection of a line disposed between the driving chip and the gate driving circuit.

In the display module provided by the present application, the gating module is disposed on the display panel.

In the display module provided by the present application, the gating module is disposed on the control platform.

The present application also provides a method of driving the display module according to any one of the display module, comprises:

a detection module detecting a fold state of a display panel;

a microcontroller outputting a corresponding driving instruction to driving chips according to the fold state of the display panel and outputting a corresponding gating instruction to a gating module;

the gating module controlling connection and disconnection of a line where the gating module is located according to the corresponding gating instruction;

the driving chips driving display areas of the display panel to display according to the driving instruction; and when the display panel is in an unfolded state, the microcontroller outputting the driving instruction to all of the driving chips, all of the driving chips working, and all of the display areas driven to display, and when the display panel is in a folded state, the microcontroller outputting the driving instruction to one of the driving chips corresponding to an unfolded one of the display areas, the driving chip corresponding to the unfolded display area working, another one of the driving chips corresponding to a folded one of the display areas not working, the unfolded display area displaying, and the folded display area not displaying.

Meanwhile, the present application also provides a display device, comprising the display module according to any one of the present application.

In the display device provided by the present application, the gating module connects to two adjacent one of the driving chips.

In the display device provided by the present application, the gating module comprises a plurality of gating units, and each of the gating units corresponds one-to-one to a connection signal disposed between the two adjacent driving chips.

In the display device provided by the present application, each of the gating units comprises a gating member, one end of the gating member is connected to one of the two adjacent driving chips, another end of the gating member is connected to another one of the two adjacent driving chips, and the gating member is configured to control connection and disconnection of a line disposed between the two adjacent driving chips.

In the display device provided by the present application, the gating module is connected to the driving chips and a gate driving circuit of the display panel.

In the display device provided by the present application, the gating module comprises a plurality of gating units, and each of the gating units corresponds one-to-one to an input signal of the gate driving circuit.

In the display device provided by the present application, each of the gating units comprises two gating members, and the two gating members respectively correspond to two of the driving chips.

In the display device provided by the present application, one end of the gating member is connected to an output end of the corresponding driving chip, the output end is corresponding to the input signal, another end of the gating member is connected to an input end of the gate driving circuit, the input end is corresponding to the input signal, and the gating member is configured to control connection and disconnection of a line disposed between the driving chip and the gate driving circuit.

In the display device provided by the present application, the gating module is disposed on the control platform.

The present application provides a display module, a driving method thereof, and a display device. The display module comprises: a display panel comprising at least two display areas and at least one folding area located between the display areas; a driving chip module comprising at least two driving chips corresponding to the display areas in one-to-one correspondence and configured to drive corresponding one of the display areas to display; a gating module connecting to the driving chips and configured to control connection or disconnection of a line where the gating module is located; a detection module configured to detect a fold state of the display panel; and a control platform comprising a microcontroller, wherein the microcontroller is configured to output a driving instruction to the driving chips and to output a gating instruction to the gating module; wherein the microcontroller outputs the driving instruction to all of the driving chips, all of the driving chips work, and all of the display areas are driven to display when the display panel is in an unfolded state, and the microcontroller outputs the driving instruction to one of the driving chips corresponding to an unfolded one of the display areas, the driving chip corresponding to the unfolded display area works, another one of the driving chips corresponding to a folded one of the display areas does not work, the unfolded display area displays, and the folded display area does not display when the display panel is in a folded state. The gating module is configured to control conduction or disconnection of the line where the gating module is located, and the microcontroller outputs the driving instruction to the driving chips, so that when the display panel is in the unfolded state, all of the driving chips work, and all of the display areas are driven to display; When the display panel is in the folded state, the driving chip corresponding to the unfolded display area works, another one of the driving chips corresponding to a folded one of the display areas does not work, the unfolded display area displays, and the folded display area does not display; that is, when the display panel is in the folded state, the microcontroller does not need to output drive the instruction to the folded drive chip, which reduces the data output of the microcontroller and reduces the power consumption of the control platform. At the same time, the folded drive chip does not need to work, and there is no drive signal output, which reduces the drive chip module Therefore, the power consumption of the entire display module in the folded state is reduced, and the problem of excessive power consumption of the existing folding display device is alleviated.

BRIEF DESCRIPTION OF DRAWINGS

The following detailed description of specific implementations of the present application in conjunction with the accompanying drawings will make the technical solutions and other beneficial effects of the present application obvious.

DETAILED DESCRIPTION OF PREFERRED EMBODIMENTS

Figure 1:
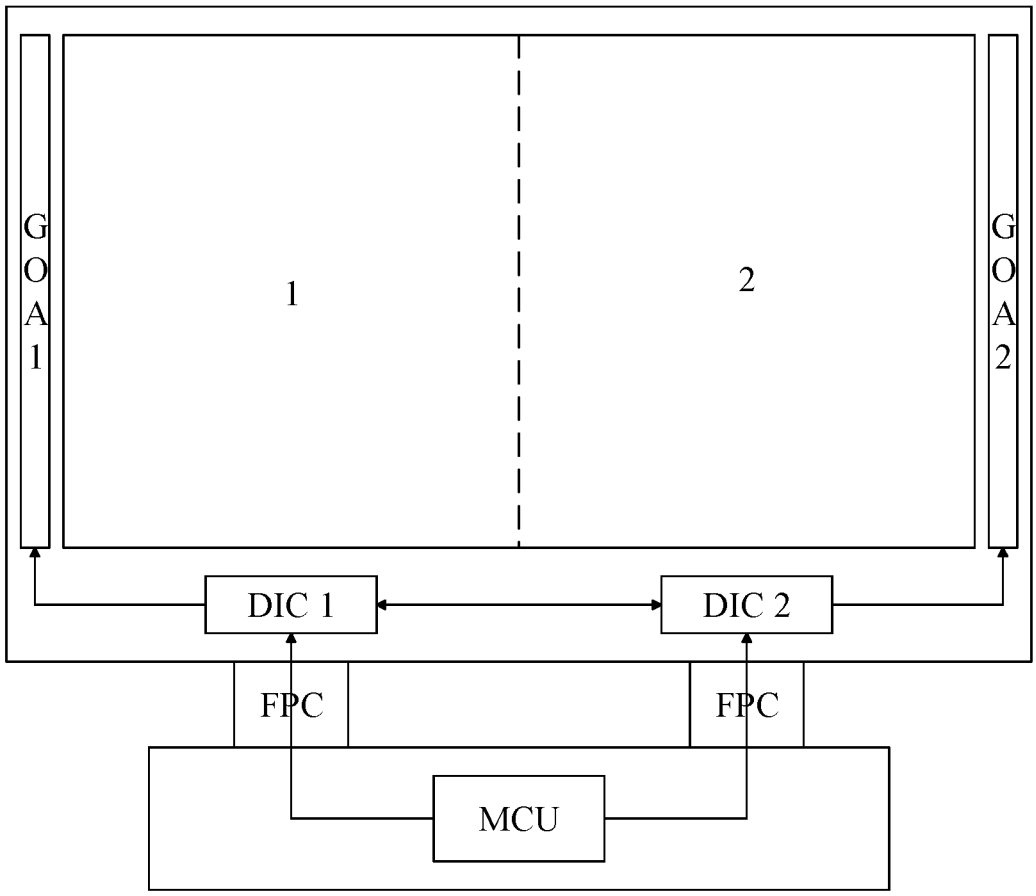
FIG. 1 is a schematic structural diagram of an existing display module.

In view of the problem of excessive power consumption in an existing folding display device, a display module provided in the present application can alleviate the problem.

In an embodiment, as shown in FIGS. 2 to 11, the display module provided by the present application comprises:

a display panel comprising at least two display areas and at least one folding area (the dotted line position in the figure) located between the display areas;

a driving chip module comprising at least two driving chips corresponding to the display areas in one-to-one correspondence and configured to drive corresponding one of the display areas to display;

a detection module (not shown) configured to detect a fold state of the display panel;

a gating module connecting to the driving chips and configured to control connection or disconnection of a line where the gating module is located;

a control platform comprising a microcontroller (Micro Controller Unit, MCU for short), wherein the microcontroller is configured to output a driving instruction to the driving chips and to output a gating instruction to the gating module;

wherein the microcontroller outputs the driving instruction to all of the driving chips, all of the driving chips work, and all of the display areas are driven to display when the display panel is in an unfolded state, and the microcontroller outputs the driving instruction to one of the driving chips corresponding to an unfolded one of the display areas, the driving chip corresponding to the unfolded display area works, another one of the driving chips corresponding to a folded one of the display areas does not work, the unfolded display area displays, and the folded display area does not display when the display panel is in a folded state.

The embodiment provides a display module, and a gating module is provided in the display module. The gating module is configured to control conduction or disconnection of the line where the gating module is located, and the microcontroller outputs the driving instruction to the driving chips, so that when the display panel is in the unfolded state, all of the driving chips work, and all of the display areas are driven to display; When the display panel is in the folded state, the driving chip corresponding to the unfolded display area works, another one of the driving chips corresponding to a folded one of the display areas does not work, the unfolded display area displays, and the folded display area does not display; that is, when the display panel is in the folded state, the microcontroller does not need to output drive the instruction to the folded drive chip, which reduces the data output of the microcontroller and reduces the power consumption of the control platform. At the same time, the folded drive chip does not need to work, and there is no drive signal output, which reduces the drive chip module Therefore, the power consumption of the entire display module in the folded state is reduced, and the problem of excessive power consumption of the existing folding display device is alleviated.

Figure 2:
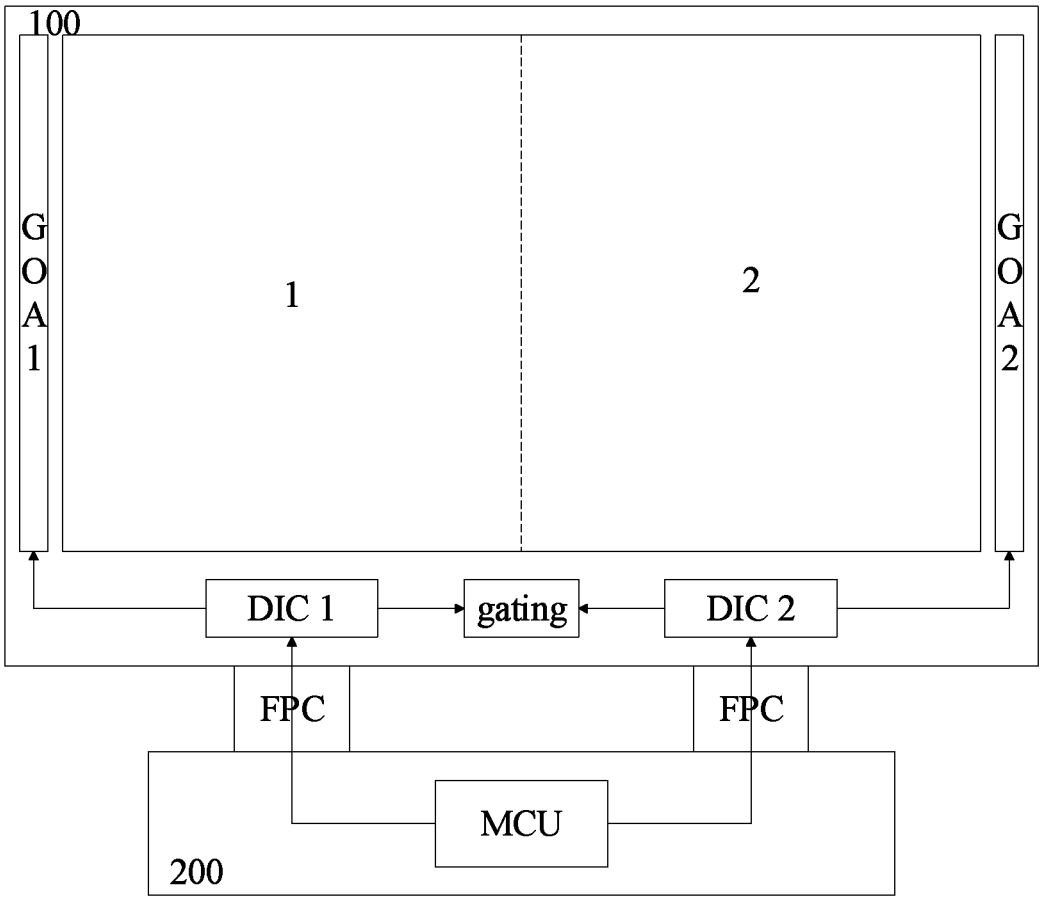
FIG. 2 is a first schematic structural diagram of a display module provided by an embodiment of the application.
Figure 3:
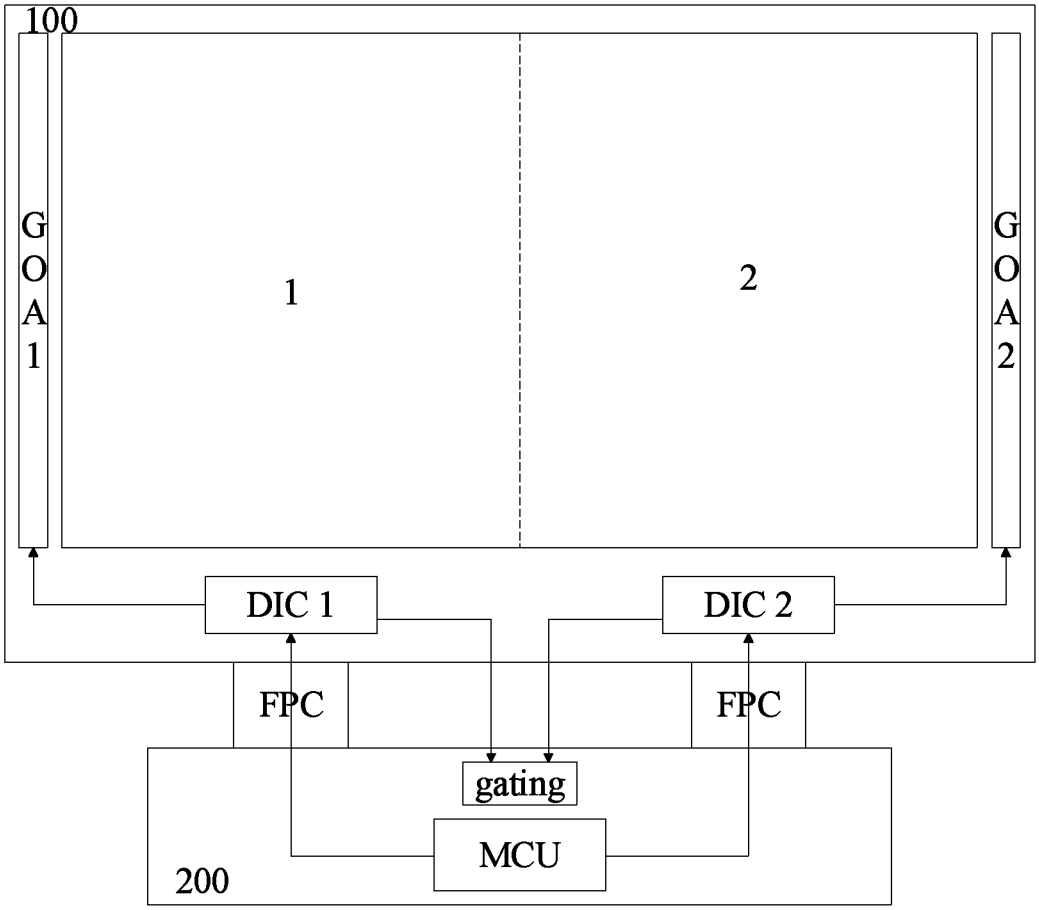
FIG. 3 is a second schematic structural diagram of a display module provided by an embodiment of the application.

In one embodiment, the gate driving circuit (Gate on Array, GOA for short) of the display panel is in a bilateral single driving mode. As shown in FIGS. 2 and 3, the display panel 100 comprises a first display area (1) and a second display area (2), and the display panel 100 can be folded at the position (the dotted line position in the figure) where the first display area (1) and the second display area (2) are connected. The gate driving circuit comprises a first gate drive circuit (GOA 1) arranged on the left side of the first display area (1), and a second gate drive circuit (GOA 2) arranged on the right side of the second display area (2).

The driving chip module comprises a first driving chip (DIC 1) and a second driving chip (DIC 2). The first driving chip (DIC 1) and the second driving chip (DIC 2) are both arranged on the display panel 100, wherein the first driving chip (DIC 1) corresponds to the first display area (1) and is configured to drive the first display area (1) to display, and the second driving chip (DIC 2) corresponds to the second display area (2) and is configured to drive the second display area (2) to display.

The control platform 200 is connected to the display panel 100 through a FPC (flexible printed circuit, flexible circuit board). The control platform 200 comprises a microcontroller (MCU). The microcontroller (MCU) is connected to the first driving chip (DIC 1) and the second driving chip (DIC 2) respectively. The microcontroller (MCU) is configured to output a driving instruction to the first driving chip (DIC 1) and the second driving chip (DIC 2).

The gating module (gating) connects to the first driving chip (DIC 1) and the second driving chip (DIC 2), and is configured to control connection or disconnection of a line between the first driving chip (DIC 1) and the second driving chip (DIC 2), thereby controlling the cascade state between the first driving chip (DIC 1) and the second driving chip (DIC 2).

In one embodiment, as shown in FIG. 2, the gating module (gating) is disposed on the display panel 100.

In another embodiment, as shown in FIG. 3, the gating module (gating) is disposed on the control platform 200.

Figure 4:
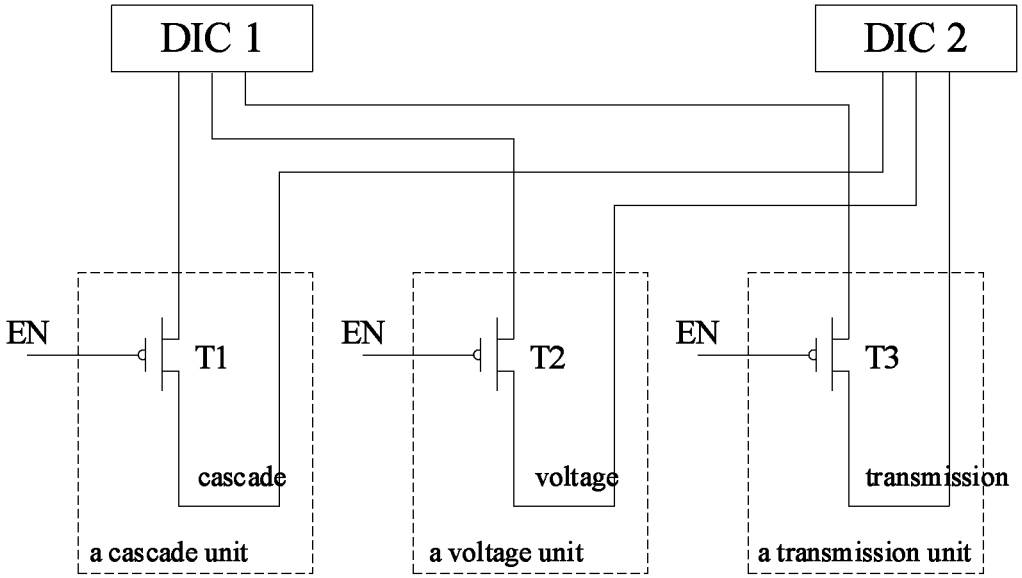
FIG. 4 is a third schematic structural diagram of a display module provided by an embodiment of the application.

For the display module shown in FIG. 2 and FIG. 3, the gating module (gating) and its connection method are shown in FIG. 4. The gating module (gating) comprises a plurality of gating units, and each of the gating units corresponds one-to-one to a connection signal disposed between the first driving chip (DIC 1) and the second driving chip (DIC 2), that is, one gating unit corresponds to one connection signal. FIG. 4 shows three types of connection signals: a cascade signal, a voltage signal, and a transmission signal. These three types of signals are only used for display and explanation, and are not intended to limit specific connection signals. The gating module (gating) comprises three gating units, which are a cascade unit, a voltage unit, and a transmission unit. Among them, the cascade unit corresponds to the cascade signal, the voltage unit corresponds to the voltage signal, and the transmission unit corresponds to the transmission signal.

The cascade unit comprises a first gating member T1, the voltage unit comprises a second gating member T2, and the transmission unit comprises a third gating member T3. The gating member is configured to control connection or disconnection of a line, and any member that can realize to control connection or disconnection of a line can be used as the gating member in this application. For the convenience of explanation, in the embodiments provided in the application, the gating members is switching transistors as examples.

A source of a first switching transistor T1 is connected to a cascade signal end of the first driving chip (DIC 1), a drain is connected to a cascade signal end of the second driving chip (DIC 2), and a gate is connected to a gate signal EN; a source of a second switching transistor T2 is connected to a voltage signal end of the first driving chip (DIC 1), a drain is connected to a voltage signal end of the second driving chip (DIC 2), and a gate is connected to the gate signal EN. A source of a third switching transistor T3 is connected to a transmission signal end of the first driving chip (DIC 1), a drain is connected to a transmission signal end of the second driving chip (DIC 2), and a gate is connected to the gate signal EN.

The gating module and its connection method provided in the embodiment can also be applied to a single-side single-drive display module, which will not be repeated here.

Figure 5:
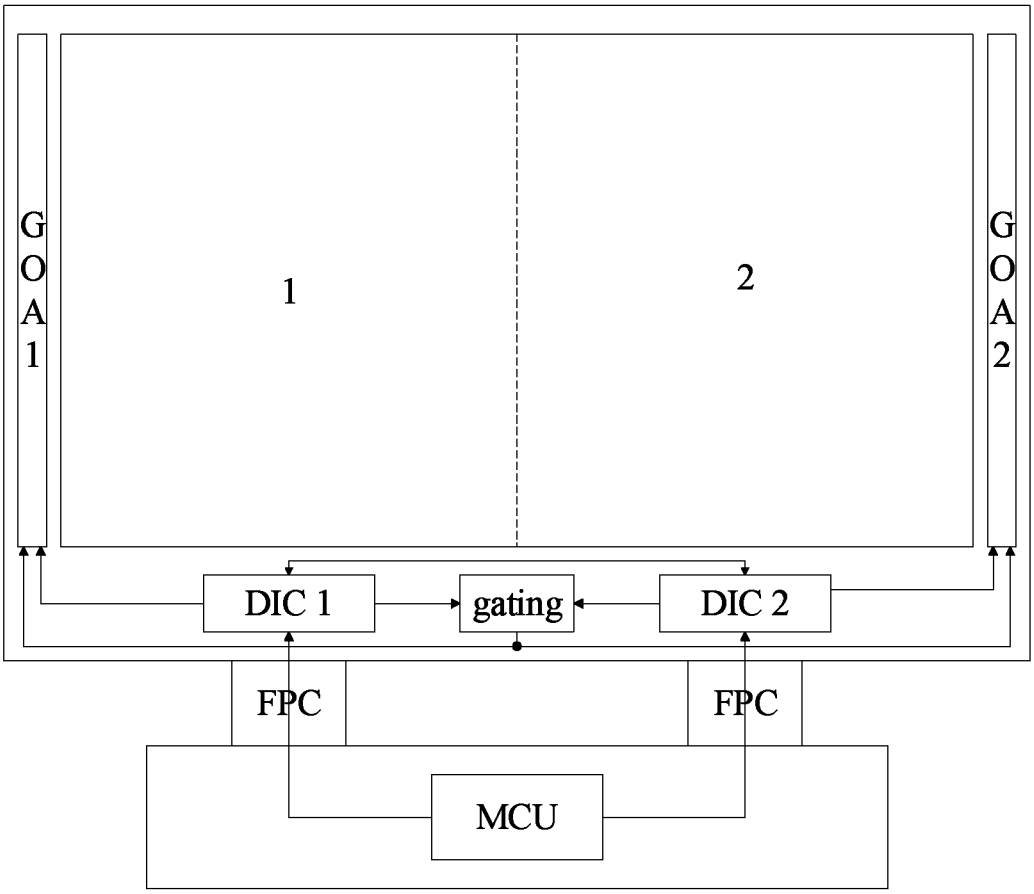
FIG. 5 is a fourth schematic structural diagram of a display module provided by an embodiment of the application.
Figure 6:
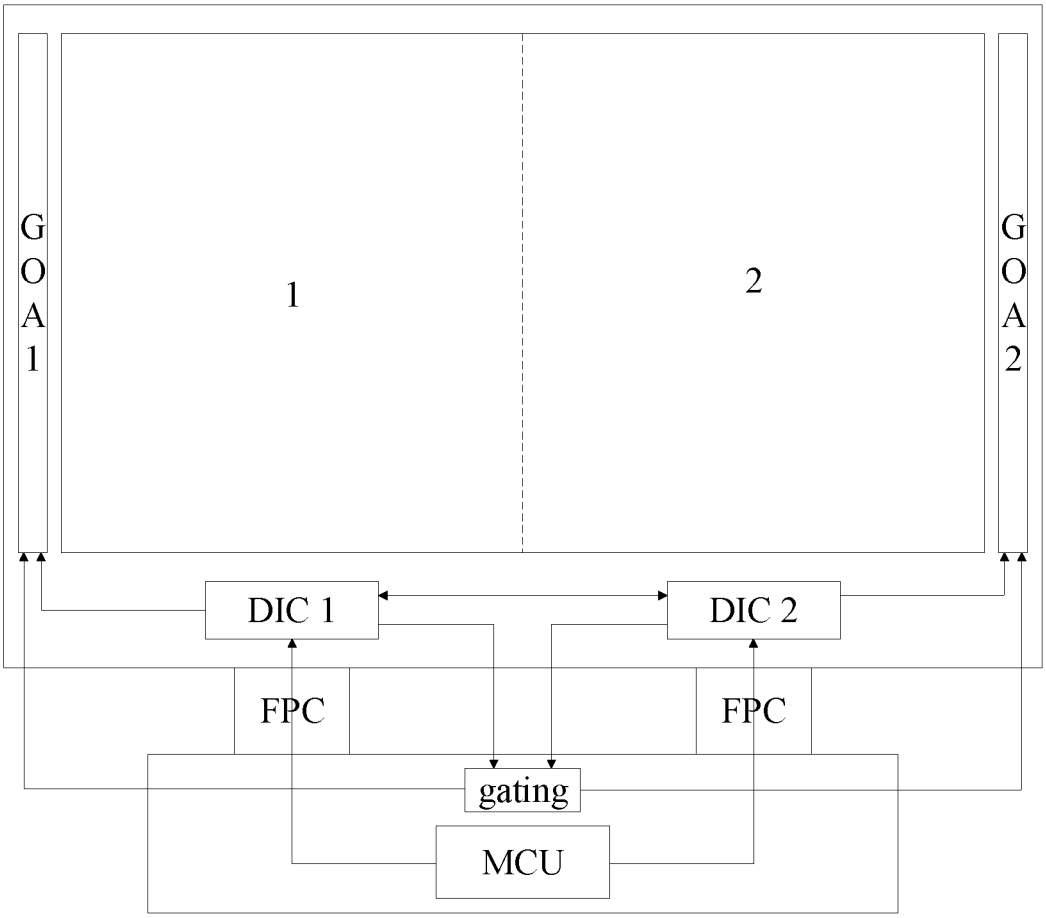
FIG. 6 is a fifth schematic structural diagram of a display module provided by an embodiment of the application.

In one embodiment, the gate driving circuit of the display panel is in a bilateral dual driving mode. As shown in FIGS. 5 and 6, the display panel 100 comprises a first display area (1) and a second display area (2), and the display panel 100 can be folded at the position (the dotted line position in the figure) where the first display area (1) and the second display area (2) are connected. The gate driving circuit comprises a first gate driving circuit (GOA 1) and a second gate driving circuit (GOA 2), the first gate driving circuit (GOA 1) is arranged on the left side of the first display area (1), the second gate driving circuit (GOA 2) is arranged on the right side of the second display area (2).

The driving chip module comprises a first driving chip (DIC 1) and a second driving chip (DIC 2). The first driving chip (DIC 1) and the second driving chip (DIC 2) are cascaded. The first driving chip (DIC 1) and the second driving chip (DIC 2) are both arranged on the display panel 100, wherein the first driving chip (DIC 1) corresponds to the first display area (1) and is configured to drive the first display area (1) to display, and the second driving chip (DIC 2) corresponds to the second display area (2) and is configured to drive the second display area (2) to display.

The control platform 200 is connected to the display panel 100 through a FPC. The control platform 200 comprises a microcontroller. The microcontroller is connected to the first driving chip (DIC 1) and the second driving chip (DIC 2) respectively. The microcontroller is configured to output a driving instruction to the first driving chip (DIC 1) and the second driving chip (DIC 2).

The gating module (gating) connects to the first driving chip (DIC 1), the second driving chip (DIC 2), the first gate driving circuit (GOA 1) and the second gate driving circuit (GOA 2). The gating module is configured to control connection and disconnection of a line between the first driving chip (DIC 1) and the second gate driving circuit (GOA 2), so that the GOA driving signal output by the first driving chip (DIC 1) can/not be reach the second gate driving circuit (GOA 2); at the same time it is configured to control connection and disconnection of a line between the second driving chip (DIC 2) and the first gate driving circuit (GOA 1), so that the GOA driving signal output by second driving chip (DIC 2) can/not be reach the first gate driving circuit (GOA 1).

In one embodiment, as shown in FIG. 5, the gating module (gating) is disposed on the display panel 100.

In another embodiment, as shown in FIG. 6, the gating module (gating) is disposed on the control platform 200.

Figure 7:
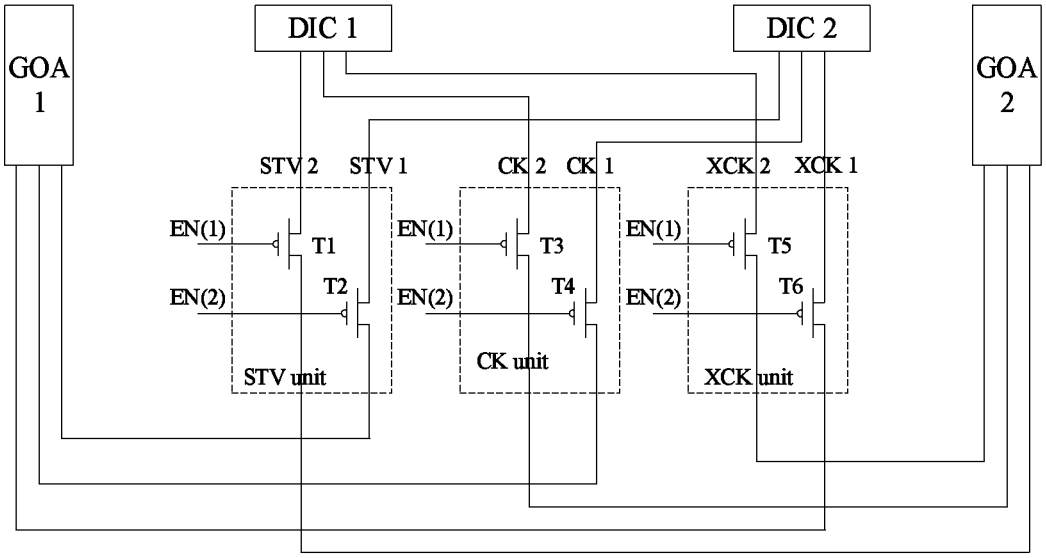
FIG. 7 is a sixth schematic structural diagram of a display module provided by an embodiment of the application.

For the display module shown in FIG. 5 and FIG. 6, the gating module (gating) and its connection method are shown in FIG. 7. The gating module comprises a plurality of gating units, and each of the gating units corresponds one to one to an input signal of the gate driving circuit. FIG. 7 shows that the gate driving circuit comprises three input signals: a scan start signal (STV), a clock signal (CK), and a clock signal (XCK). These three signals are only used for display and explanation, and are not intended to limit the specific input signal. The gating module (gating) comprises three gating units, namely a STV unit, a CK unit and a XCK unit. The STV unit corresponds to the scan start signal (STV), the CK unit corresponds to the clock signal (CK), and the XCK unit corresponds to On the clock signal (XCK).

The STV unit comprises a first switching transistor T1 and a second switching transistor T2, the CK unit comprises a third switching transistor T3 and a fourth switching transistor T4, and the XCK unit comprises a fifth switching transistor T5 and a sixth switching transistor T6.

A source of the first switching transistor T1 is connected to a scan start signal (STV 2) output end of the first driving chip (DIC 1), a drain is connected to a scan start signal (STV 2) input end of the second gate driving circuit (GOA 2), and a gate is connected to the gate signal EN(1) of the first driving chip (DIC 1); a source of the second switch transistor T2 is connected to a scan start signal (STV 1) output end of the second driving chip (DIC 2), a drain is connected to a scan start signal (STV 1) input end of the first gate driving circuit (GOA 1), and a gate is connected to the gate signal EN(2) of the second driving chip (DIC 2).

A source of the third switching transistor T3 is connected to an output end of the clock signal (CK 2) of the first driving chip (DIC 1), and a drain is connected to an input end of the clock signal (CK 2) of the second gate driving circuit (GOA 2), a gate is connected to the gate signal EN(1) of the first driving chip (DIC 1); a source of the fourth switch transistor T4 is connected to a clock signal (CK 1) output end of the second driving chip (DIC 2), a drain is connected to a clock signal (CK 1) input end of the first gate driving circuit (GOA 1), and a gate is connected to the gate signal EN(2) of the second driving chip (DIC 2).

A source of the fifth switch transistor T5 is connected to an output end of the clock signal (XCK 2) of the first driving chip (DIC 1), and a drain is connected to an input end of the clock signal (XCK 2) of the second gate driving circuit (GOA 2), a gate is connected to the gate signal EN(1) of the first driving chip (DIC 1); a source of the sixth switch transistor T6 is connected to an output end of the clock signal (XCK 1) of the second driving chip (DIC 2), a drain is connected to a clock signal (XCK 1) input end of the first gate driving circuit (GOA 1), and a gate is connected to the gate signal EN(2) of the second driving chip (DIC 2).

Figure 8:
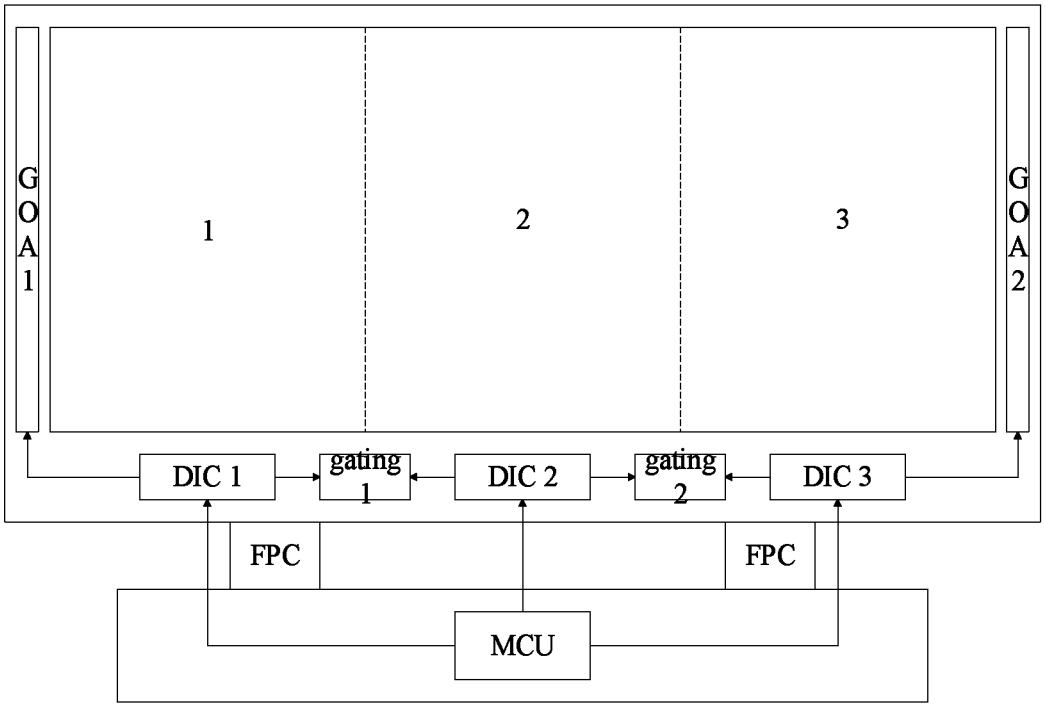
FIG. 8 is a seventh schematic structural diagram of a display module provided by an embodiment of the application.

In one embodiment, the gate driving circuit of the display panel is in a bilateral single driving mode. As shown in FIG. 8, the display panel 100 comprises a first display area (1), a second display area (2), and a third display area (3). The display panel 100 can be folded at the position where the first display area (1) and the second display area (2) are connected, and the position (the dotted line in the figure) where the second display area (2) and the third display area (3) are connected. The gate driving circuit comprises a first gate driving circuit (GOA 1) and a second gate driving circuit (GOA 2). The first gate driving circuit (GOA 1) is arranged on the left side of the first display area (1), the second gate drive circuit (GOA 2) is arranged on the right side of the third display area (3).

The driving chip module comprises a first driving chip (DIC 1), a second driving chip (DIC 2), and a third driving chip (DIC 3). The first driving chip (DIC 1), the second driving chip (DIC 2) and the third driving chip (DIC 3) are both arranged on the display panel 100, wherein the first driving chip (DIC 1) corresponds to the first display area (1) and is configured to drive the first display area (1) to display, and the second driving chip (DIC 2) corresponds to the second display area (2) and is configured to drive the second display area (2) to display, and the third driving chip (DIC 3) corresponds to the third display area (3) and is configured to drive the third display area (2) to display.

The control platform 200 is connected to the display panel 100 through a FPC. The control platform 200 comprises a microcontroller (MCU). The microcontroller (MCU) is connected to the first driving chip (DIC 1), the second driving chip (DIC 2) and the third driving chip (DIC 3) respectively. The microcontroller (MCU) is configured to output a driving instruction to the first driving chip (DIC 1), the second driving chip (DIC 2) and the third driving chip (DIC 3).

The gating module comprises a first gating module (gating 1) and a second gating module (gating 2). The first gating module (gating 1) connects to the first driving chip (DIC 1) and the second driving chip (DIC 2), and is configured to control connection or disconnection of a line between the first driving chip (DIC 1) and the second driving chip (DIC 2), thereby controlling the cascade state between the first driving chip (DIC 1) and the second driving chip (DIC 2); the second gating module (gating 2) connects to the second driving chip (DIC 2) and the third driving chip (DIC 3), and is configured to control connection or disconnection of a line between the second driving chip (DIC 2) and the third driving chip (DIC 3), thereby controlling the cascade state between the second driving chip (DIC 2) and the third driving chip (DIC 3).

In one embodiment, as shown in FIG. 8, the gating module is disposed on the display panel 100.

In another embodiment, the gating module is disposed on the control platform 200.

Figure 9:
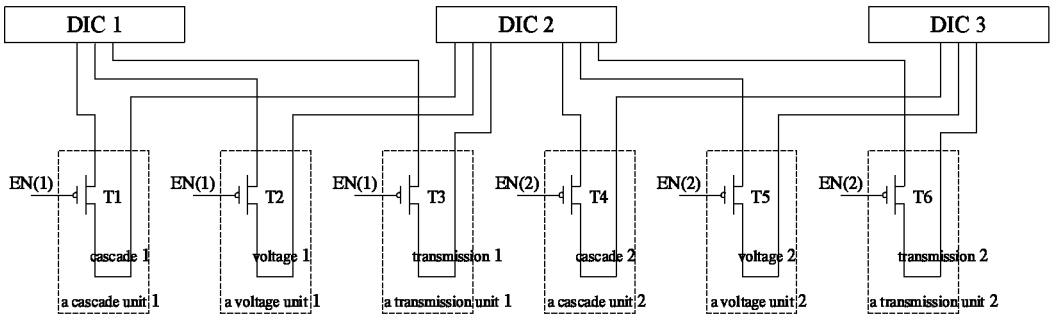
FIG. 9 is a eighth schematic structural diagram of a display module provided by an embodiment of the application.

For the display module shown in FIG. 8, its gating module and its connection method are shown in FIG. 9. The gating module comprises a plurality of gating units, and each of the gating units corresponds one-to-one to a connection signal disposed between the driving chips, that is, one gating unit corresponds to one connection signal. FIG. 9 shows three types of connection signals: a cascade signal, a voltage signal, and a transmission signal. These three types of signals are only used for display and explanation, and are not intended to limit specific connection signals. The first gating module (gating 1) comprises three gating units, which are a cascade unit 1, a voltage unit 1, and a transmission unit 1. Among them, the cascade unit 1 corresponds to the cascade signal 1, the voltage unit 1 corresponds to the voltage signal 1, and the transmission unit 1 corresponds to the transmission signal 1. The second gating module (gating 2) comprises three gating units, which are a cascade unit 2, a voltage unit 2, and a transmission unit 2. Among them, the cascade unit 2 corresponds to the cascade signal 2, the voltage unit 2 corresponds to the voltage signal 2, and the transmission unit 2 corresponds to the transmission signal 2.

The cascade unit 1 comprises a first switching transistor T1, the voltage unit 1 comprises a second switching transistor T2, the transmission unit 1 comprises a third switching transistor T3, the cascade unit 2 comprises a fourth switching transistor T4, and the voltage unit 2 comprises a fifth switching transistor T5, the transmission unit 2 comprises a sixth switching transistor T6.

A source of the first switching transistor T1 is connected to a cascade signal 1 end of the first driving chip (DIC 1), a drain is connected to a cascading signal 1 end of the second driving chip (DIC 2), and a gate is connected to the first gate signal EN (1); a source of the second switching transistor T2 is connected to a voltage signal 1 end of the first driving chip (DIC 1), a drain is connected to a voltage signal 1 end of the second driving chip (DIC 2), and a gate is connected to the first gate signal EN (1); a source of the third switching transistor T3 is connected to a transmission signal 1 end of the first driving chip (DIC 1), a drain is connected to a transmission signal of the second driving chip (DIC 2) end 1 is connected, and a gate is connected to the first gate signal EN (1).

A source of the fourth switching transistor T4 is connected to a cascade signal 2 end of the second driving chip (DIC 2), a drain is connected to a cascade signal 2 end of the third driving chip (DIC 3), and a gate is connected to the second gate signal EN (2); a source of the fifth switching transistor T5 is connected to a voltage signal 2 end of the second driving chip (DIC 2), a drain is connected to a voltage signal 2 end of the third driving chip (DIC 3), and a gate is connected to the second gate signal EN (2); a source of the sixth switching transistor T6 is connected to a transmission signal 2 end of the second driving chip (DIC 2), a drain is connected to a transmission signal 2 end of the third driving chip (DIC 3), and a gate is connected to the second gate signal EN (2).

The gating module and its connection method provided in the embodiment can also be applied to a single-side single-drive display module, which will not be repeated here.

Figure 10:
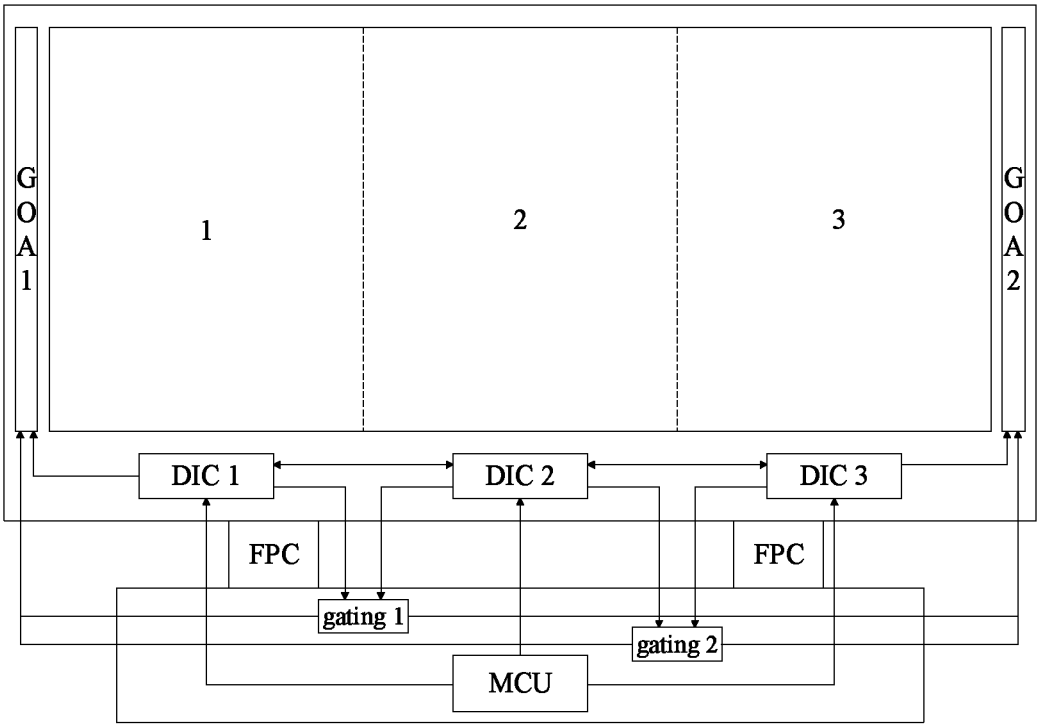
FIG. 10 is a ninth schematic structural diagram of a display module provided by an embodiment of the application.

In one embodiment, the gate driving circuit of the display panel is in a bilateral single driving mode. As shown in FIG. 10, the display panel 100 comprises a first display area (1), a second display area (2), and a third display area (3). The display panel 100 can be folded at the position where the first display area (1) and the second display area (2) are connected, and the position (the dotted line in the figure) where the second display area (2) and the third display area (3) are connected. The gate driving circuit comprises a first gate driving circuit (GOA 1) and a second gate driving circuit (GOA 2). The first gate driving circuit (GOA 1) is arranged on the left side of the first display area (1), the second gate drive circuit (GOA 2) is arranged on the right side of the third display area (3).

The driving chip module comprises a first driving chip (DIC 1), a second driving chip (DIC 2), and a third driving chip (DIC 3). The first driving chip (DIC 1) and the second driving chip (DIC 2) are cascaded, and the second driving chip (DIC 2) and the third driving chip (DIC 3) are cascaded. The first driving chip (DIC 1), the second driving chip (DIC 2) and the third driving chip (DIC 3) are both arranged on the display panel 100, wherein the first driving chip (DIC 1) corresponds to the first display area (1) and is configured to drive the first display area (1) to display, and the second driving chip (DIC 2) corresponds to the second display area (2) and is configured to drive the second display area (2) to display, and the third driving chip (DIC 3) corresponds to the third display area (3) and is configured to drive the third display area (2) to display.

The control platform 200 is connected to the display panel 100 through a FPC. The control platform 200 comprises a microcontroller (MCU). The microcontroller (MCU) is connected to the first driving chip (DIC 1), the second driving chip (DIC 2) and the third driving chip (DIC 3) respectively. The microcontroller (MCU) is configured to output a driving instruction to the first driving chip (DIC 1), the second driving chip (DIC 2) and the third driving chip (DIC 3).

The gating module comprises a first gating module (gating 1) and a second gating module (gating 2). The first gating module (gating 1) connects to the first driving chip (DIC 1), the second driving chip (DIC 2), the first gate driving circuit (GOA 1) and the second gate driving circuit (GOA 2), and is configured to control connection or disconnection of a line between the first driving chip (DIC 1) and the second gate driving circuit (GOA 2), so that the GOA driving signal output by the first driving chip (DIC 1) can/not be reach the second gate driving circuit (GOA 2); at the same time it is configured to control connection or disconnection of a line between the second driving chip (DIC 2) and the first gate drive circuit (GOA 1), so that the GOA driving signal output by the second driving chip (DIC 2) can/not be reach the first gate driving circuit (GOA 1).

The second gating module (gating 2) connects to the second driving chip (DIC 2), the third driving chip (DIC 3), the first gate driving circuit (GOA 1) and the second gate driving circuit (GOA 2), and is configured to control connection or disconnection of a line between the second driving chip (DIC 2) and the second gate driving circuit (GOA 2), so that the GOA driving signal output by the second driving chip (DIC 2) can/not be reach the second gate driving circuit (GOA 2); at the same time it is configured to control connection or disconnection of a line between the third driving chip (DIC 3) and the first gate drive circuit (GOA 1), so that the GOA driving signal output by the third driving chip (DIC 3) can/not be reach the first gate driving circuit (GOA 1).

In one embodiment, the gating module is disposed on the display panel 100.

In another embodiment, as shown in FIG. 10, the gating module is disposed on the control platform 200.

Figure 11:
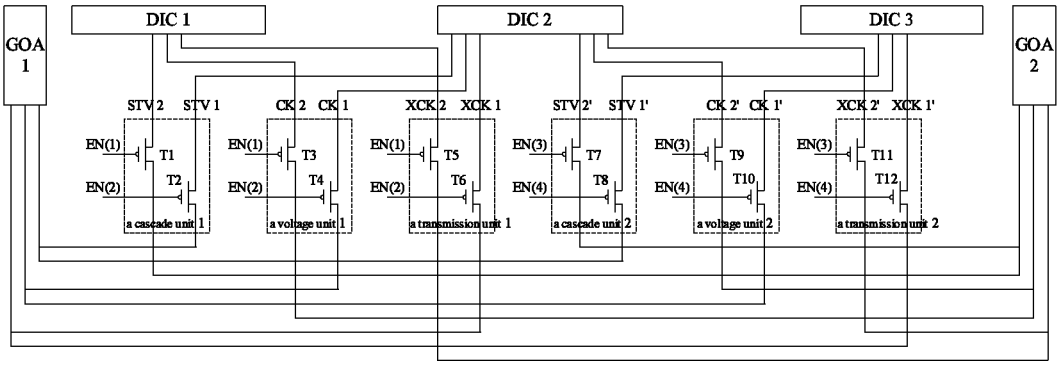
FIG. 11 is a tenth schematic structural diagram of a display module provided by an embodiment of the application.

For the display module shown in FIG. 10, the gating module and its connection method are shown in FIG. 11. The gating module comprises a plurality of gating units, and each of the gating units corresponds one to one to an input signal of the gate driving circuit. FIG. 11 shows that the first gate driving circuit (GOA 1) comprises three input signals: a scan start signal (STV), a clock signal (CK), and a clock signal (XCK). These three signals are only used for display and explanation, and are not intended to limit the specific input signal. The first gating module comprises three gating units, namely a STV unit 1, a CK unit 1 and a XCK unit 1. The second gating module comprises three gating units, namely a STV unit 2, a CK unit 2 and a XCK unit 2.

The STV unit 1 comprises a first switching transistor T1 and a second switching transistor T2, the CK unit 1 comprises a third switching transistor T3 and a fourth switching transistor T4, and the XCK unit 1 comprises a fifth switching transistor T5 and a sixth switching transistor T6. The STV unit 2 comprises a seventh switching transistor T7 and an eighth switching transistor T8, the CK unit 2 comprises a ninth switching transistor T9 and a tenth switching transistor T10, and the XCK unit 2 comprises an eleventh switching transistor T11 and a twelfth switching transistor T12.

A source of the first switching transistor T1 is connected to a scan start signal (STV 2) output end of the first driving chip (DIC 1), and a drain is connected to a scan start signal (STV 2) input end of the second gate driving circuit (GOA 2), and a gate is connected to the gate signal EN(1) of the first driving chip (DIC 1); a source of the second switching transistor T2 is connected to a scan start signal (STV 1) output end of the second driving chip (DIC 2), a drain is connected to a scan start signal (STV 1) input end of the first gate drive circuit (GOA 1), and a gate is connected to the gate signal EN(2) of the second driving chip (DIC 2).

A source of the third switching transistor T3 is connected to an output end of the clock signal (CK 2) of the first driving chip (DIC 1), and a drain is connected to an input end of the clock signal (CK 2) of the second gate driving circuit (GOA 2), and a gate is connected to the gate signal EN(1) of the first driving chip (DIC 1); a source of the fourth switching transistor T4 is connected to a clock signal (CK 1) output end of the second driving chip (DIC 2), a drain is connected to a clock signal (CK 1) input end of the first gate driving circuit (GOA 1), and a gate is connected to the gate signal EN(2) of the second driving chip (DIC 2).

A source of the fifth switching transistor T5 is connected to an output end of the clock signal (XCK 2) of the first driving chip (DIC 1), and a drain is connected to an input end of the clock signal (XCK 2) of the second gate driving circuit (GOA 2), and a gate is connected to the gate signal EN(1) of the first driving chip (DIC 1); a source of the sixth switch transistor T6 is connected to an output end of the clock signal (XCK 1) of the second driving chip (DIC 2), a drain is connected to an input end of the clock signal (XCK 1) of the first gate driving circuit (GOA 1), and a gate is connected to the gate signal EN(2) of the second driving chip (DIC 2).

A source of the seventh switching transistor T7 is connected to a scan start signal (STV 2') output end of the second driving chip (DIC 2), and a drain is connected to a scan start signal (STV 2') input end of the second gate driving circuit (GOA 2), and a gate is connected to the gate signal EN(3) of the second driving chip (DIC 2); a source of the eighth switching transistor T8 is connected to a scan start signal (STV 1') output end of the third driving chip (DIC 3), a drain is connected to a scan start signal (STV 1') input end of the first gate driving circuit (GOA 1), and a gate is connected to the gate signal EN(4) of the third driving chip (DIC 3).

A source of the ninth switching transistor T9 is connected to an output end of the clock signal (CK 2') of the second driving chip (DIC 2), and a drain is connected to a clock signal (CK 2') input end of the second gate driving circuit (GOA 2), and a gate is connected to the gate signal EN(3) of the second driving chip (DIC 2); a source of the tenth switching transistor T10 is connected to an output end of the clock signal (CK 1') of the third driving chip (DIC 2), and a drain is connected to a clock signal (CK 1') input end of the first gate driving circuit (GOA 1), and a gate is connected to the gate signal EN (4) of the third driving chip (DIC 3).

A source of the eleventh switching transistor T11 is connected to an output end of the clock signal (XCK 2') of the second driving chip (DIC 2), and a drain is connected to a clock signal (XCK 2') input end of the second gate drive circuit (GOA 2), and a gate is connected to the gate signal EN(3) of the second driving chip (DIC 2); a source of the twelfth switching transistor T12 is connected to an output end of the clock signal (XCK 1') of the third driving chip (DIC 2), and a drain is connected to a clock signal (XCK 1') input end of the first gate driving circuit (GOA 1), and a gate is connected to the gate signal EN(4) of the third driving chip (DIC 3).

In other embodiments, the display panel may also comprises four, five, or even more display areas, and the setting of the display modules can refer to the two or three display areas mentioned above, and the details will not be described in detail.

Figure 12:
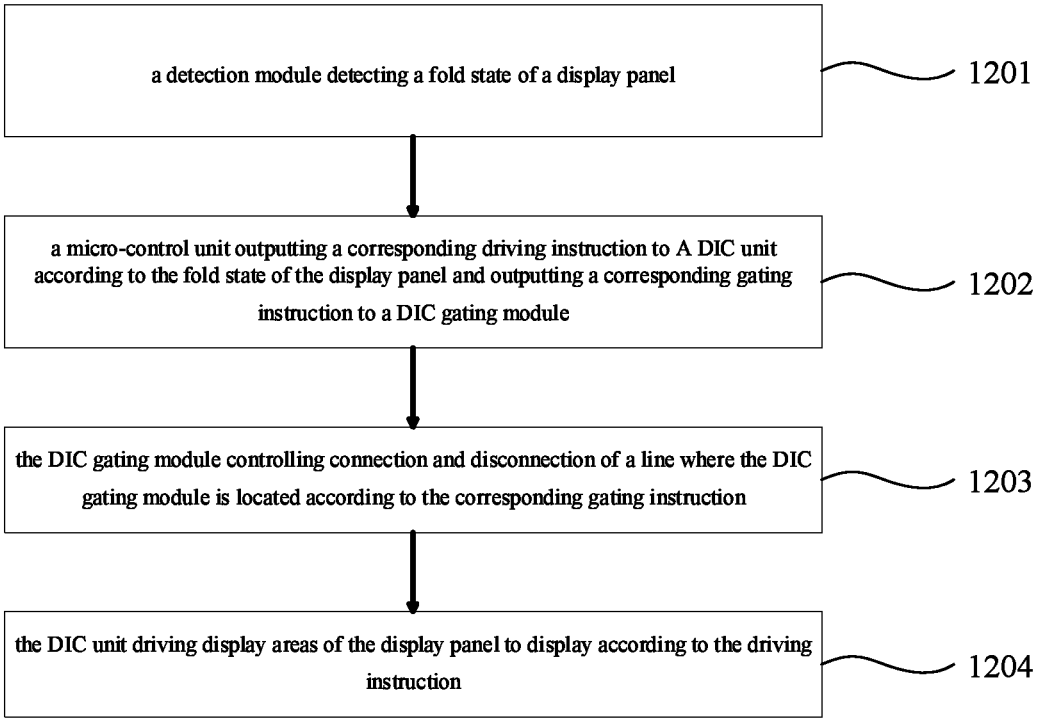
FIG. 12 is a first flowchart of a driving method of a display module provided by an embodiment of the application.
Figure 13:
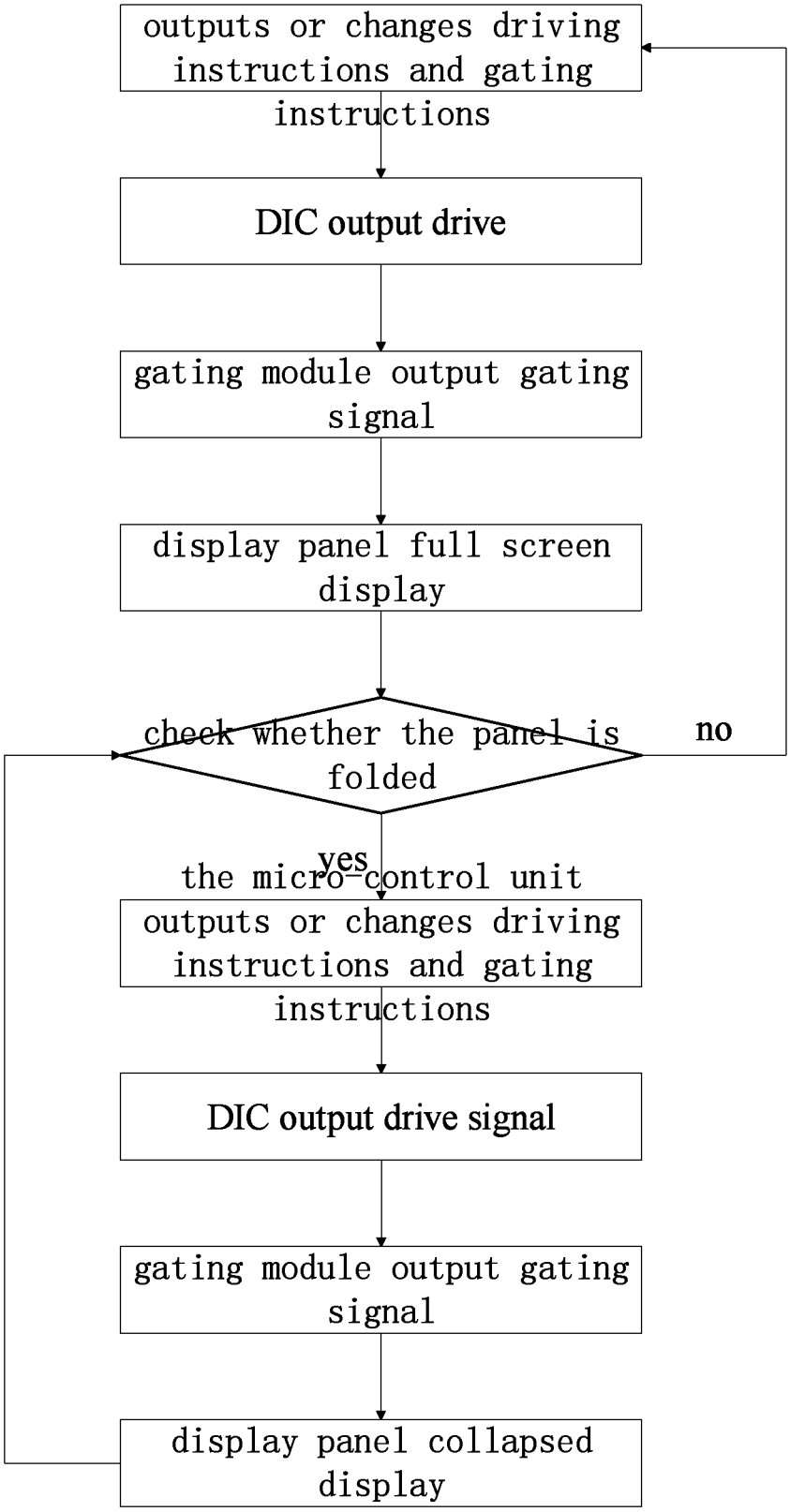
FIG. 13 is a second flowchart of a driving method of a display module provided by an embodiment of the application.

At the same time, an embodiment of the present application provides a driving method of a display device for driving the above-mentioned display device. As shown in FIG. 12, the driving method comprises:

Step S1202, a detection module detecting a fold state of a display panel;

Step S1202, a microcontroller outputting a corresponding driving instruction to driving chips according to the fold state of the display panel and outputting a corresponding gating instruction to a gating module;

Step S1203, the gating module controlling connection and disconnection of a line where the gating module is located according to the corresponding gating instruction;

Step S1204, the driving chips driving display areas of the display panel to display according to the driving instruction;

when the display panel is in an unfolded state, the microcontroller outputting the driving instruction to all of the driving chips, all of the driving chips working, and all of the display areas driven to display, and when the display panel is in a folded state, the microcontroller outputting the driving instruction to one of the driving chips corresponding to an unfolded one of the display areas, the driving chip corresponding to the unfolded display area working, another one of the driving chips corresponding to a folded one of the display areas not working, the unfolded display area displaying, and the folded display area not displaying.

The embodiment provides a method of driving the display module. The gating module is configured to control conduction or disconnection of the line where the gating module is located, and the microcontroller outputs the driving instruction to the driving chips, so that when the display panel is in the unfolded state, all of the driving chips work, and all of the display areas are driven to display; When the display panel is in the folded state, the driving chip corresponding to the unfolded display area works, another one of the driving chips corresponding to a folded one of the display areas does not work, the unfolded display area displays, and the folded display area does not display; that is, when the display panel is in the folded state, the microcontroller does not need to output drive the instruction to the folded drive chip, which reduces the data output of the microcontroller and reduces the power consumption of the control platform. At the same time, the folded drive chip does not need to work, and there is no drive signal output, which reduces the drive chip module Therefore, the power consumption of the entire display module in the folded state is reduced, and the problem of excessive power consumption of the existing folding display device is alleviated.

The driving method of the display device provided in the present application will be explained in detail below in conjunction with specific embodiments. In the following embodiments, the gate components are all switching transistors, and the switching transistors are all N-type thin film transistors. When the gate of the N-type thin film transistor is input with a high potential, the N-type thin film transistor is turned on.

In an embodiment, the structure of the display module is shown in FIGS. 2 to 4, and in combination with 2 to 4, and 12 to 15, the driving method of the display module comprises:

The fold state of the display panel is detected by the detection module. When the display panel is in the unfolded state, the microcontroller (MCU) outputs a conduction command to the gating module (gating), The gates of the first switching transistor T1, the second switching transistor T2 and the third switching transistor T3 in the gating module gating) simultaneously input a high-potential gate signal EN, the first switching transistor T1, the second switching transistor T2, and the third switching transistor T3 are turned on, and the first driving chip (DIC 1) and the second driving chip (DIC 2) are cascaded; the microcontroller (MCU) outputs driving instructions to the first driving chip (DIC 1) and the second driving chip (DIC 2) simultaneously, the first driving chip (DIC 1) outputs driving signal to the first display area (1), drive the first display area (1) to display, and the second driving chip (DIC 2) outputs driving signal to the second display area (2), drive the second display area (2) to display, so that all of the display areas of the display panel are displayed.

Figure 14:
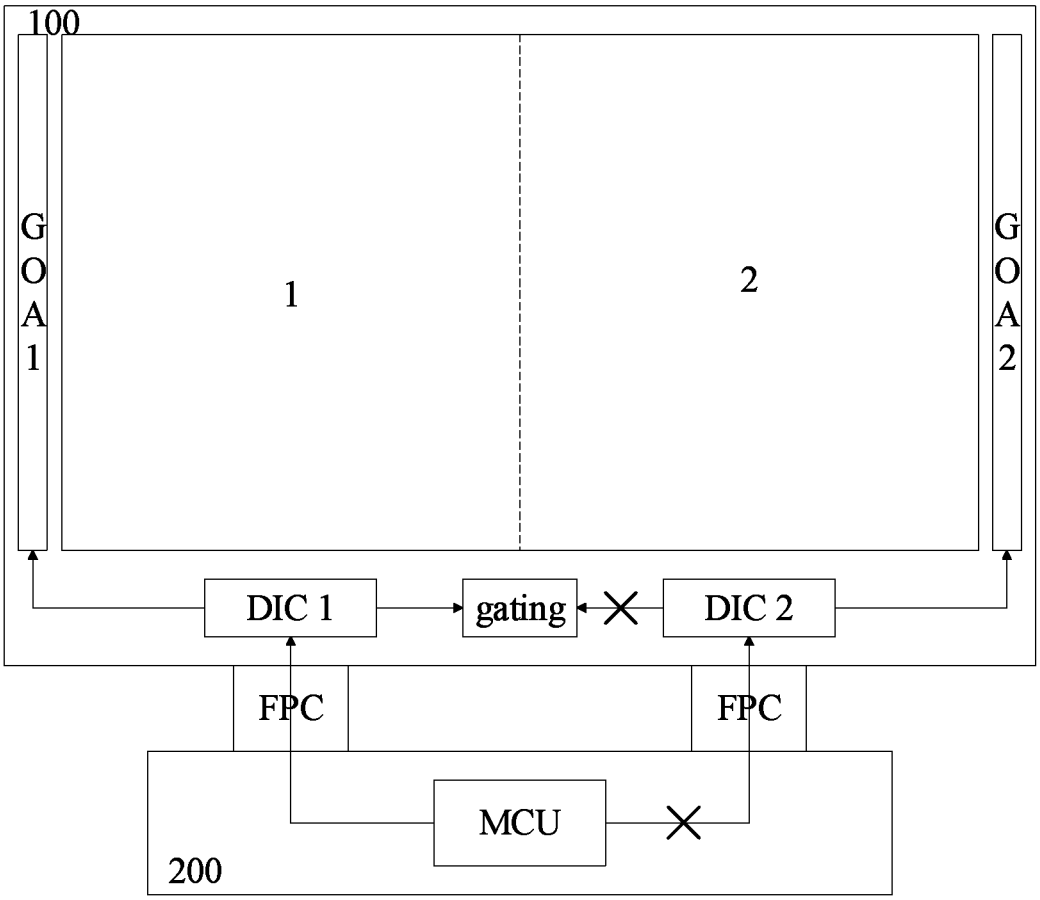
FIG. 14 is a first driving schematic diagram of a display module provided by an embodiment of the application.

When the display panel is in the folded state and the second display area (2) is folded, as shown in FIG. 14, the microcontroller (MCU) outputs a disconnection instruction to the gating module (gating). The gates of the first switching transistor T1, the second switching transistor T2 and the third switching transistor T3 have no high-potential gate signal EN input, the first switching transistor T1, the second switching transistor T2 and the third switching transistor T3 are both disconnected, the first driving chip (DIC 1) and the second driving chip (DIC 2) are disconnected; the microcontroller (MCU) outputs driving instructions to the first driving chip (DIC 1), and the first driving chip (DIC 1)) outputs a drive signal to the first display area (1) to drive the first display area (1) to display, the second driving chip (DIC 2) does not work, and the second display area (2) does not display.

Figure 15:
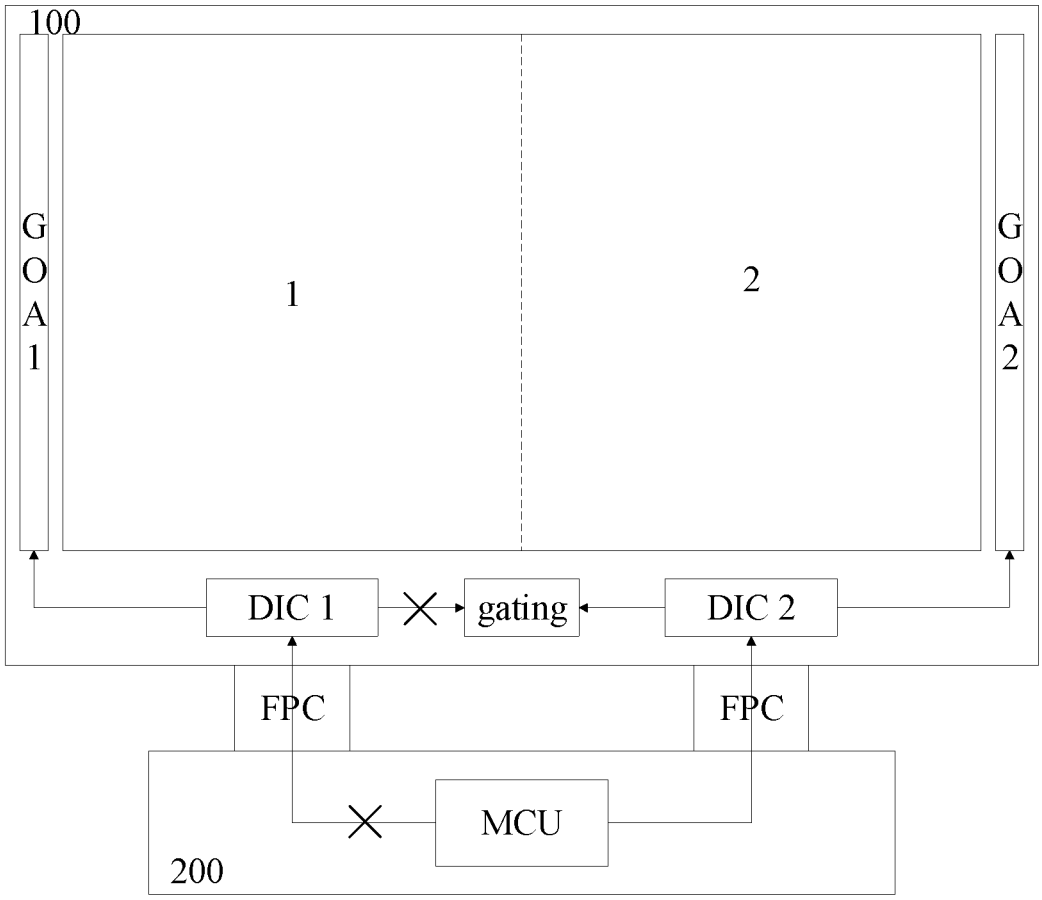
FIG. 15 is a second driving schematic diagram of a display module provided by an embodiment of the application.

Similarly, when the display panel is in the folded state and the first display area (1) is folded, as shown in FIG. 15, the microcontroller (MCU) outputs a disconnection instruction to the gating module (gating). The gates of the first switching transistor T1, the second switching transistor T2 and the third switching transistor T3 in the gating module (gating) have no high-potential strobe signal EN input. The first switching transistor T1, the second switching transistor T2 and the third The switching transistors T3 are all disconnected, and the first driving chip (DIC 1) and the second driving chip (DIC 2) are disconnected; the microcontroller (MCU) outputs driving instructions to the second driving chip (DIC 2), and the second driving chip (DIC 2) qutputs a driving signal to the second display area (2) to drive the second display area (2) to display, the first driving chip (DIC 1) does not work, and the first display area (1) does not display.

The embodiment provides a driving method suitable for a display module in a dual-side single-drive mode and a single-side dual-drive mode. The driving method enables all of the driving chips working, and all of the display areas driven to display when the display panel is in an unfolded state; when the display panel is in the folded state, the driving chip corresponding to the unfolded display area works, another one of the driving chips corresponding to a folded one of the display areas does not work, the unfolded display area displays, and the folded display area does not display; that is, when the display panel is in the folded state, the microcontroller does not need to output drive the instruction to the folded drive chip, which reduces the data output of the microcontroller and reduces the power consumption of the control platform. At the same time, the folded drive chip does not need to work, and there is no drive signal output, which reduces the drive chip module Therefore, the power consumption of the entire display module in the folded state is reduced, and the problem of excessive power consumption of the existing folding display device is alleviated.

In one embodiment, the structure of the display module is shown in FIGS. 5 to 7. In combination with 5 to FIG. 7, FIG. 12, FIG. 13, FIG. 16, and FIG. 17, the driving method of the display module comprises:

The fold state of the display panel is detected by the detection module. When the display panel is in the unfolded state, the microcontroller (MCU) outputs a disconnect command to the gating module (gatinge). The gates of the first switching transistor T1, the second switching transistor T2, the third switching transistor T3, the fourth switching transistor T4, the fifth switching transistor T5, and the sixth switching transistor T6 in the gating module (gating) have no high potential gate signal input, and the first switching transistor T1, the second switching transistor T2, the third switching transistor T3, the fourth switching transistor T4, the fifth switching transistor T5, and the sixth switching transistor T6 are all off, the first driving chip (DIC 1) and the second driving chip (DIC 2) are cascaded; the microcontroller (MCU) outputs driving instructions to the first driving chip (DIC 1) and the second driving chip (DIC 2) simultaneously, the first driving chip (DIC 1) outputs driving signal to the first display area (1), drive the first display area (1) to display, and the second driving chip (DIC 2) outputs driving signal to the second display area (2), drive the second display area (2) to display, so that all of the display areas of the display panel are displayed.

Figure 16:
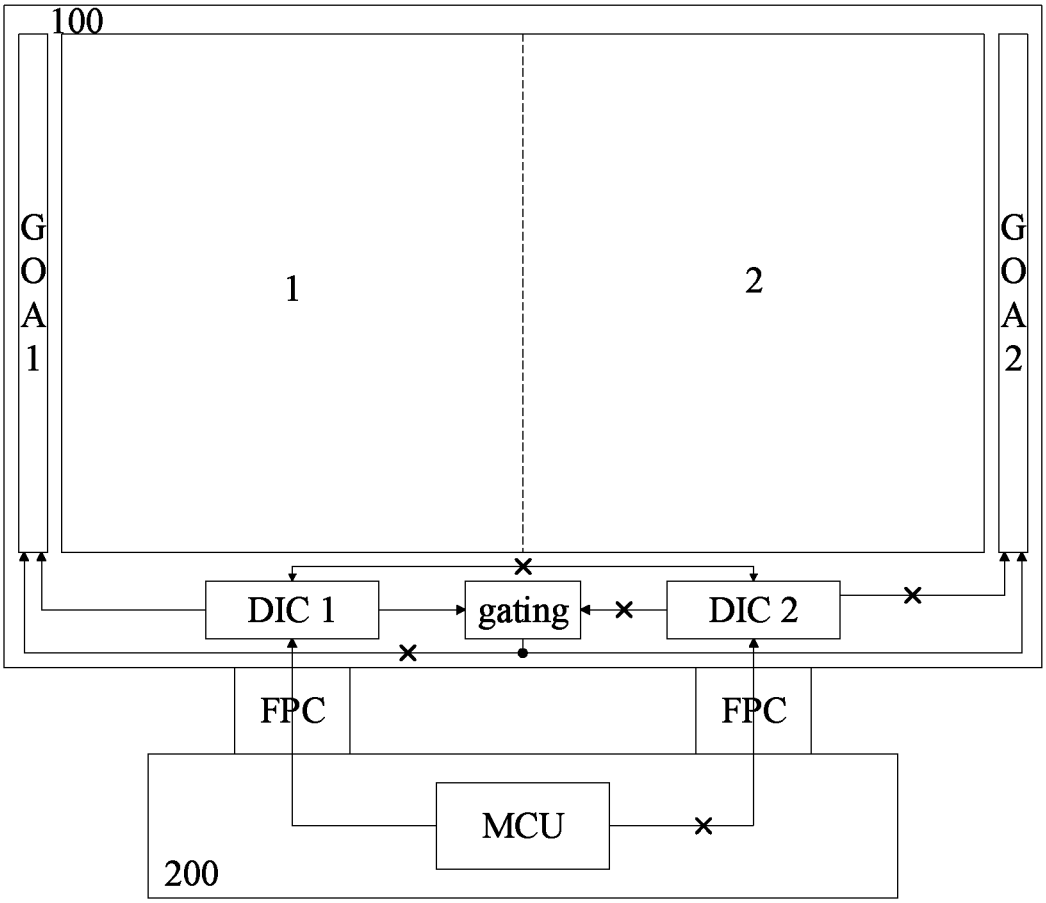
FIG. 16 is a third driving schematic diagram of a display module provided by an embodiment of the application.

When the display panel is in the folded state and the second display area (2) is folded, as shown in FIG. 16, the microcontroller (MCU) outputs a turn-on command to the first switching transistor T1, the third switching transistor T3, and the fifth switching transistor T5 corresponding to the first display area (1). The gates of the first switching transistor T1, the third switching transistor T3 and the fifth switching transistor T5 simultaneously input the first gate signal EN(1) without high potential. The switching transistor T1, the third switching transistor T3, and the fifth switching transistor T5 are turned on, and the first driving chip (DIC 1) and the second gate driving circuit (GOA 2) are turned on.

The microcontroller (MCU) outputs an off instruction to the second switching transistor T2, the fourth switching transistor T4, and the sixth switching transistor T6 corresponding to the second display area (2), and the gates of the second switching transistor T2, the fourth switching transistor T4, and the sixth switching transistor T6 have no high-potential gate signal input, the second switching transistor T2, the fourth switching transistor T4 and the sixth switching transistor T6 are disconnected, and the second driving chip (DIC 2) is connected to the first gate driving circuit (GOA 1) is disconnected.

The microcontroller (MCU) outputs driving instructions to the first driving chip (DIC 1), and the first driving chip (DIC 1) outputs driving signals to the first display area (1), and simultaneously output the first GOA drive signal to the first gate drive circuit (GOA 1). The second GOA driving signal is output to the second gate driving circuit (GOA 2) through the gating module (gating) to drive the first display area (1) to display; the second driving chip (DIC 2) does not work, and the second display area (2) is not displayed.

Figure 17:
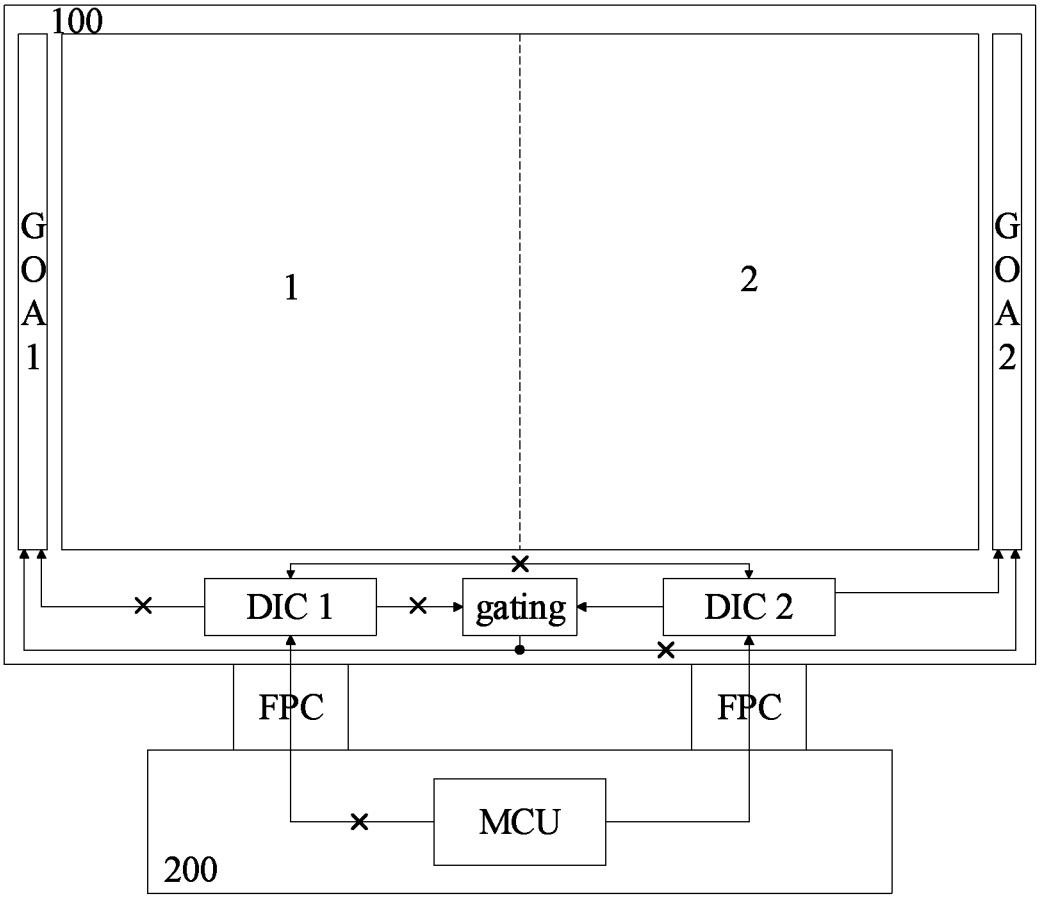
FIG. 17 is a fourth driving schematic diagram of a display module provided by an embodiment of the application.
Figure 18:
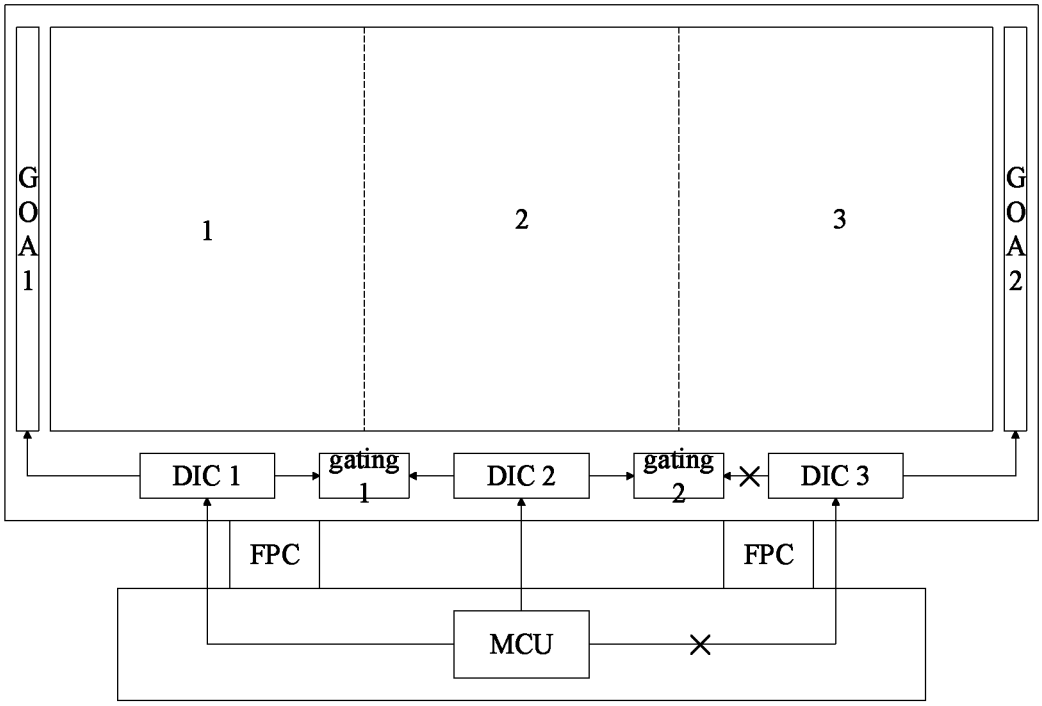
FIG. 18 is a fifth driving schematic diagram of a display module provided by an embodiment of the application.

Similarly, when the display panel is in the folded state and the first display area (1) is folded, as shown in FIG. 17, the microcontroller (MCU) outputs an off instruction to the first switching transistor T1, the third switching transistor T3, and the fifth switching transistor T5 corresponding to the first display area (1), the gates of the first switching transistor T1, the third switching transistor T3 and the fifth switching transistor T5 have no high-potential gate signal EN input, and the first switching transistor T1, the third switching transistor T3 and the fifth switching transistor T5 are turned off, and the first driving chip (DIC 1) is disconnected from the second gate driving circuit (GOA 2).

The microcontroller (MCU) outputs a turn-on command to the second switching transistor T2, the fourth switching transistor T4, and the sixth switching transistor T6 corresponding to the second display area (2). The gates of the second switching transistor T2, the fourth switching transistor T4, and the sixth switching transistor T6 are input with the second gate signal EN(2) of high potential, the second switching transistor T2, the fourth switching transistor T4, and the sixth switching transistor T6 are turned on, and the second driving chip (DIC 2) is connected to the first gate driving circuit (GOA 1).

The microcontroller (MCU) outputs drive instructions to the second driving chip (DIC 2), and the second driving chip (DIC 2) outputs drive signals to the first display area (2), and at the same time, the first GOA drive signal is output to the first gate driving circuit (GOA 1) through the gating module (gating), and the second GOA drive signal is output to the second gate driving circuit (GOA 2) to drive the second display area (2) display; the first driving chip (DIC 1) does not work, the first display area (1) does not display.

The embodiment provides a driving method suitable for a display module in a dual-side dual-drive mode. The driving method enables all of the driving chips working, and all of the display areas driven to display when the display panel is in an unfolded state; when the display panel is in the folded state, the driving chip corresponding to the unfolded display area works, another one of the driving chips corresponding to a folded one of the display areas does not work, the unfolded display area displays, and the folded display area does not display; that is, when the display panel is in the folded state, the microcontroller does not need to output drive the instruction to the folded drive chip, which reduces the data output of the microcontroller and reduces the power consumption of the control platform. At the same time, the folded drive chip does not need to work, and there is no drive signal output, which reduces the drive chip module Therefore, the power consumption of the entire display module in the folded state is reduced, and the problem of excessive power consumption of the existing folding display device is alleviated.

In an embodiment, the structure of the display module is as shown in FIG. 8 and FIG. 9. With reference to FIG. 8, FIG. 9, FIG. 12, FIG. 13, and FIG. 18, the driving method of the display module comprises:

The fold state of the display panel is detected by the detection module. When the display panel is in the unfolded state, the microcontroller (MCU) outputs a turn-on command to both the first gating module (gating 1) and the second gating module (gating 2). The switching transistors in the first gating module (gating 1) and the second gating module (gating 2) are both turned on, the first driving chip (DIC 1) and the second driving chip (DIC 2) are cascaded, the second driving chip (DIC 2) and the third driving chip (DIC 3) are cascaded; the microcontroller (MCU) outputs driving instructions to the first driving chip (DIC 1), the second driving chip (DIC 2) and the third driving chip (DIC 3) simultaneously, and drives all of the display areas of the display panel to display.

Figure 19:
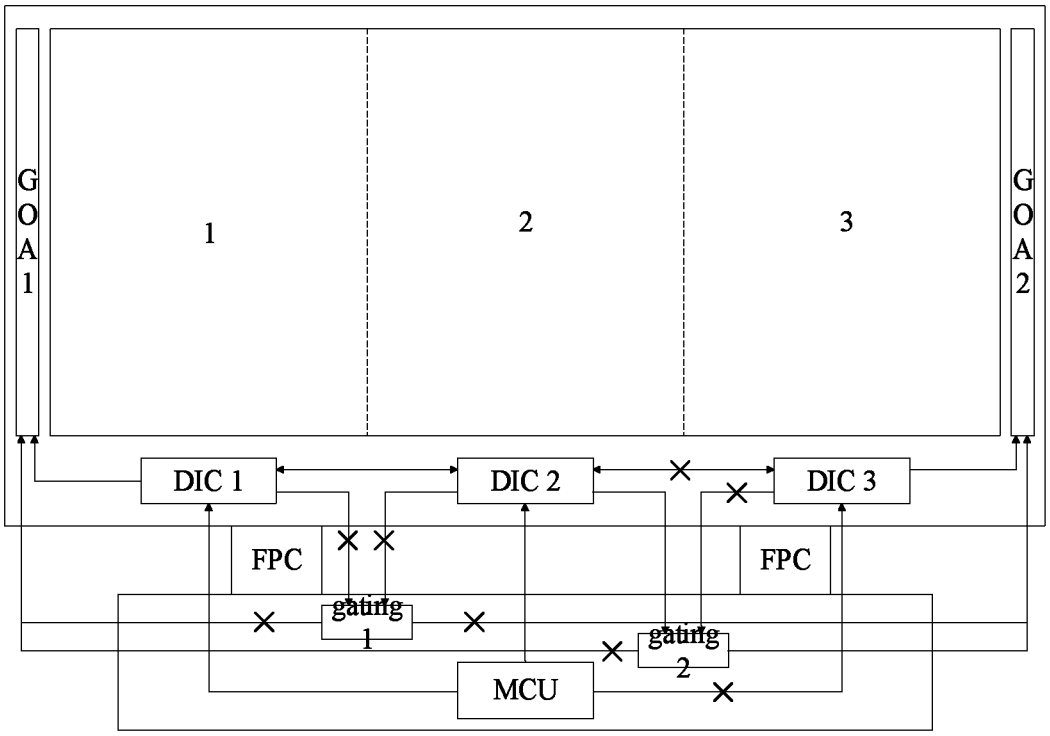
FIG. 19 is a sixth driving schematic diagram of a display module provided by an embodiment of the application.

When the display panel is in the folded state, such as when the third display area (3) is folded, as shown in FIG. 19, the microcontroller (MCU) outputs a turn-on command to the first gating module (gating 1), The switching transistors in the pass module (gatinge 1) are all turned on, the first driving chip (DIC 1) and the second driving chip (DIC 2) are cascaded, and a disconnect command is output to the second gating module (gating 2), The switching transistors in the second gating module (gating 2) are all disconnected, the second driving chip (DIC 2) and the third driving chip (DIC 3) are disconnected; the microcontroller (MCU) is connected to the first driving chip (DIC 1) and the second driving chip (DIC 2) simultaneously output drive instructions, drive the first display area (1) and the second display area (2) to display, drive the first display area (1) to display, and the third driving chip (DIC 3) does not work, and the third display area (3) does not display.

For the driving methods in other folding modes, please refer to the driving method when the third display area (3) is folded, and the details are not repeated here.

In one embodiment, the structure of the display module is shown in FIG. 10 and FIG. 11. With reference to FIG. 10, FIG. 11, FIG. 12, FIG. 13, and FIG. 19, the driving method of the display module comprises:

The fold state of the display panel is detected by the detection module. When the display panel is in the unfolded state, the microcontroller (MCU) outputs a disconnection command to the gating module (gating), and the switching transistors in the gating module are all turned off. The first driving chip (DIC 1) and the second driving chip (DIC 2) are cascaded, and the second driving chip (DIC 2) and the third driving chip (DIC 3) are cascaded; the microcontroller (MCU) is connected to the first driving chip (DIC 1) and the second driving chip (DIC 2) simultaneously output drive instructions to drive all display areas of the display panel.

When the display panel is in the folded state, such as when the third display area (3) is folded, as shown in FIG. 19, the microcontroller (MCU) pairs the switch connecting the second driving chip (DIC 2) and the second gate driving circuit The transistor outputs the turn-on command, which is the second driving chip (DIC 2) and the second gate driving circuit (GOA 2); the remaining switching transistors output the turn-off command, the first driving chip (DIC 1) and the second Driver chip (DIC 2) cascade.

The microcontroller (MCU) outputs drive instructions to the first driving chip (DIC 1) and the second driving chip (DIC 2), and the first driving chip (DIC 1) outputs drive signals to the first display area (1) and simultaneously the first gate driving circuit (GOA 1) outputs the first GOA drive signal to drive the first display area (1) to display; the second driving chip (DIC 2) outputs a driving signal to the second display area (2), and at the same time outputs a second GOA driving signal to the second gate driving circuit (GOA 2) through the second gating module (gating 2), drive the second display area (2) to display; the third driving chip (DIC 3) does not work, and the third display area (3) does not display.

For the driving methods in other folding modes, please refer to the driving method when the third display area (3) is folded, and the details are not repeated here.

For the display module with more than three display areas, the driving method is similar to the driving method of the display module with three display areas. For details, please refer to the above-mentioned embodiment, which will not be described in detail here.

In addition, an embodiment of the present application also provides a display device, which includes the above-mentioned display module, wherein the specific structure of the display module has been described in detail in the above-mentioned embodiment and will not be repeated here. The display device can be any electronic device with a display function, such as a mobile phone, a tablet, a notebook computer, an electronic paper book, or a television.

According to the above embodiment, it can be seen that:

The present application provides a display module, a driving method thereof, and a display device. The display module comprises: a display panel comprising at least two display areas and at least one folding area located between the display areas; a driving chip module comprising at least two driving chips corresponding to the display areas in one-to-one correspondence and configured to drive corresponding one of the display areas to display; a gating module connecting to the driving chips and configured to control connection or disconnection of a line where the gating module is located; a detection module configured to detect a fold state of the display panel; and a control platform comprising a microcontroller, wherein the microcontroller is configured to output a driving instruction to the driving chips and to output a gating instruction to the gating module; wherein the microcontroller outputs the driving instruction to all of the driving chips, all of the driving chips work, and all of the display areas are driven to display when the display panel is in an unfolded state, and the microcontroller outputs the driving instruction to one of the driving chips corresponding to an unfolded one of the display areas, the driving chip corresponding to the unfolded display area works, another one of the driving chips corresponding to a folded one of the display areas does not work, the unfolded display area displays, and the folded display area does not display when the display panel is in a folded state. The gating module is configured to control conduction or disconnection of the line where the gating module is located, and the microcontroller outputs the driving instruction to the driving chips, so that when the display panel is in the unfolded state, all of the driving chips work, and all of the display areas are driven to display; When the display panel is in the folded state, the driving chip corresponding to the unfolded display area works, another one of the driving chips corresponding to a folded one of the display areas does not work, the unfolded display area displays, and the folded display area does not display; that is, when the display panel is in the folded state, the microcontroller does not need to output drive the instruction to the folded drive chip, which reduces the data output of the microcontroller and reduces the power consumption of the control platform. At the same time, the folded drive chip does not need to work, and there is no drive signal output, which reduces the drive chip module Therefore, the power consumption of the entire display module in the folded state is reduced, and the problem of excessive power consumption of the existing folding display device is alleviated.

In summary, although the application has been disclosed as above in preferred embodiments, the above-mentioned preferred embodiments are not intended to limit the application, and those of ordinary skill in the art can make various decisions without departing from the spirit and scope of the application. Such changes and modifications, so the scope of protection of this application is subject to the scope defined by the claims.

What is claimed is:

1. A display module, comprising:

a display panel comprising at least two display areas and at least one folding area located between the display areas;

a driving chip module comprising at least two driving chips corresponding to the display areas in a one-to-one correspondence and configured to drive a corresponding one of the display areas to display;

a gating module connecting to the driving chips and configured to control connection or disconnection of a line where the gating module is located;

a detection module configured to detect a fold state of the display panel; and a control platform comprising a microcontroller, wherein the microcontroller is configured to output a driving instruction to the driving chips and to output a gating instruction to the gating module;

wherein when the display panel is in an unfolded state, the microcontroller outputs the driving instruction to each of the at least two driving chips, each of the at least two driving chips is driven to work, and each of the at least two display areas is driven to display; and wherein when the display panel is in a folded state, the microcontroller outputs the driving instruction to one of the at least two driving chips corresponding to an unfolded one of the at least two display areas, only the one of the at least two driving chips corresponding to the unfolded one of the at least two display areas is driven to work, and only the unfolded one of the at least two display areas is driven to display.

2. The display module of claim 1, wherein the gating module connects to two adjacent one of the driving chips.

3. The display module of claim 2, wherein the gating module comprises a plurality of gating units, and each of the gating units corresponds one-to-one to a connection signal disposed between the two adjacent driving chips.

4. The display module of claim 3, wherein each of the gating units comprises a gating member, one end of the gating member is connected to one of the two adjacent driving chips, another end of the gating member is connected to another one of the two adjacent driving chips, and the gating member is configured to control connection and disconnection of a line disposed between the two adjacent driving chips.

5. The display module of claim 1, wherein the gating module is connected to the driving chips and a gate driving circuit of the display panel.

6. The display module of claim 5, wherein the gating module comprises a plurality of gating units, and each of the gating units corresponds one-to-one to an input signal of the gate driving circuit.

7. The display module of claim 6, wherein each of the gating units comprises two gating members, and the two gating members respectively correspond to two of the driving chips.

8. The display module of claim 7, wherein one end of the gating member is connected to an output end of the corresponding driving chip, the output end is corresponding to the input signal, another end of the gating member is connected to an input end of the gate driving circuit, the input end is corresponding to the input signal, and the gating member is configured to control connection and disconnection of a line disposed between the driving chip and the gate driving circuit.

9. The display module of claim 1, wherein the gating module is disposed on the display panel.

10. The display module of claim 1, wherein the gating module is disposed on the control platform.

11. A method of driving a display module, the display module comprising:

a display panel comprising at least two display areas and at least one folding area located between the display areas;

a driving chip module comprising at least two driving chips corresponding to the display areas in a one-to-one correspondence and configured to drive a corresponding one of the display areas to display;

a gating module connecting to the driving chips and configured to control connection or disconnection of a line where the gating module is located;

a detection module configured to detect a fold state of the display panel; and a control platform comprising a microcontroller, wherein the microcontroller is configured to output a driving instruction to the driving chips and to output a gating instruction to the gating module;

wherein the method of driving the display module comprises:

a detection module detecting a fold state of a display panel;

a microcontroller outputting a corresponding driving instruction to driving chips according to the fold state of the display panel and outputting a corresponding gating instruction to a gating module;

the gating module controlling connection and disconnection of a line where the gating module is located according to the corresponding gating instruction;

the driving chips driving display areas of the display panel to display according to the driving instruction; and wherein when the display panel is in an unfolded state, the microcontroller outputs the driving instruction to each of the at least two driving chips, each of the at least two driving chips is driven to work, and each of the at least two display areas is driven to display, and wherein when the display panel is in a folded state, the microcontroller outputs the driving instruction to one of the at least two driving chips corresponding to an unfolded one of the at least two display areas, only the one of the at least two driving chips corresponding to the unfolded one of the at least two display areas is driven to work, and only the one of the at least two unfolded display areas is driven to display.

12. A display device, comprising a display module according to claim 1, the display module comprising:

a display panel comprising at least two display areas and at least one folding area located between the display areas;

a driving chip module comprising at least two driving chips corresponding to the display areas in a one-to-one correspondence and configured to drive a corresponding one of the display areas to display;

a gating module connecting to the driving chips and configured to control connection or disconnection of a line where the gating module is located;

a detection module configured to detect a fold state of the display panel; and a control platform comprising a microcontroller, wherein the microcontroller is configured to output a driving instruction to the driving chips and to output a gating instruction to the gating module;

wherein when the display panel is in an unfolded state, the microcontroller outputs the driving instruction to each of the at least two driving chips, each of the at least two driving chips is driven to work, and each of the at least two display areas is driven to display; and wherein when the display panel is in a folded state, the microcontroller outputs the driving instruction to one of the at least two driving chips corresponding to an unfolded one of the at least two display areas, only the one of the at least two driving chips corresponding to the unfolded one of the at least two display areas is driven to work, and only the unfolded one of the at least two display areas is driven to display.

13. The display device of claim 12, wherein the gating module connects to two adjacent one of the driving chips.

14. The display device of claim 13, wherein the gating module comprises a plurality of gating units, and each of the gating units corresponds one-to-one to a connection signal disposed between the two adjacent driving chips.

15. The display device of claim 14, wherein each of the gating units comprises a gating member, one end of the gating member is connected to one of the two adjacent driving chips, another end of the gating member is connected to another one of the two adjacent driving chips, and the gating member is configured to control connection and disconnection of a line disposed between the two adjacent driving chips.

16. The display device of claim 12, wherein the gating module is connected to the driving chips and a gate driving circuit of the display panel.

17. The display device of claim 16, wherein the gating module comprises a plurality of gating units, and each of the gating units corresponds one-to-one to an input signal of the gate driving circuit.

18. The display device of claim 17, wherein each of the gating units comprises two gating members, and the two gating members respectively correspond to two of the driving chips.

19. The display device of claim 18, wherein one end of the gating member is connected to an output end of the corresponding driving chip, the output end is corresponding to the input signal, another end of the gating member is connected to an input end of the gate driving circuit, the input end is corresponding to the input signal, and the gating member is configured to control connection and disconnection of a line disposed between the driving chip and the gate driving circuit.

20. The display device of claim 1, wherein the gating module is disposed on the control platform.

* * * * *